US011136791B2

(12) United States Patent
Hsu

(10) Patent No.: US 11,136,791 B2
(45) Date of Patent: Oct. 5, 2021

(54) MODULARIZED ELECTRIC LATCH CONTROL DEVICE

(71) Applicant: I-TEK METAL MFG. CO., LTD, Tainan (TW)

(72) Inventor: Wei-Chung Hsu, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 662 days.

(21) Appl. No.: 16/019,787

(22) Filed: Jun. 27, 2018

(65) Prior Publication Data

US 2019/0376317 A1 Dec. 12, 2019

(30) Foreign Application Priority Data

Jun. 7, 2018 (TW) ..... 107119621

(51) Int. Cl.

| | |
|---|---|
| ***E05B 47/06*** | (2006.01) |
| ***E05B 47/00*** | (2006.01) |
| ***E05B 63/00*** | (2006.01) |
| ***E05B 63/24*** | (2006.01) |
| ***E05B 15/02*** | (2006.01) |

(52) U.S. Cl.

CPC ..... *E05B 47/0611* (2013.01); *E05B 15/02* (2013.01); *E05B 47/0001* (2013.01); *E05B 63/0065* (2013.01); *E05B 63/24* (2013.01); *E05B 2047/0023* (2013.01); *E05B 2063/0082* (2013.01)

(58) Field of Classification Search

CPC ..... Y10T 292/68; Y10T 292/696; Y10T 292/699; Y10T 292/705; Y10T 292/707; E05B 47/0046; E05B 47/0047; E05B 15/024

See application file for complete search history.

(56) References Cited

U.S. PATENT DOCUMENTS

| | | | | |
|---|---|---|---|---|
| 8,366,160 | B2 * | 2/2013 | Orbeta | E05B 47/0047 292/341.16 |
| 10,781,611 | B2 * | 9/2020 | Schildwachter | E05B 17/2084 |
| 2013/0088023 | A1 * | 4/2013 | Singh | E05B 47/0047 292/341.16 |
| 2017/0009487 | A1 * | 1/2017 | Chang | E05B 15/0245 |
| 2017/0292290 | A1 * | 10/2017 | Schildwachter | E05B 47/0047 |

* cited by examiner

*Primary Examiner* — Kristina R Fulton
*Assistant Examiner* — Noah Horowitz
(74) *Attorney, Agent, or Firm* — Alan D. Kamrath; Karin L. Williams; Mayer & Williams PC

(57) ABSTRACT

A modularized electric latch control device includes a mounting seat and a locking cap device pivotably mounted to the mounting seat and pivotable relative to the mounting seat between a closure position and a non-closure position. Optionally mounted to the electric latch control device are a stopper, a closure member, a locking latch restraining frame, a first escutcheon, and a second escutcheon. The electric latch control device is selectively assembled into a first mode (including the first escutcheon), a second mode (including the closure member, the stopper, and the second escutcheon), or a third mode (including the locking latch restraining frame, the stopper, and the second escutcheon) for cooperating with a cylindrical latch device, a first box type latch device, or a second box type latch device.

21 Claims, 20 Drawing Sheets

MODULARIZED ELECTRIC LATCH CONTROL DEVICE

BACKGROUND OF THE INVENTION

The present invention relates to a latch control device and, more particularly, to a modularized electric latch control device that can be assembled into one of a plurality of different modes for cooperating with different types of latch devices that can be locked or unlocked through electric control.

A lock mounted on a door generally includes a latch device operable by an inner operational device and/or an outer operational device. The type of the latch device can be disposed differently according to different needs or situations. For example, a simple cylindrical latch device includes a retractable latch. A more complicated box type latch device includes a retractable latch and an anti-pick bolt. A further more complicated box type latch device includes a retractable latch, an anti-pick bolt, and a locking latch providing a secondary locking function. The latch, anti-pick latch, and the locking latch can be arranged in different sequences or have different sizes. Thus, the door frame must include at least one latch hole to cooperate with the cylindrical latch device or the box type latch device. Furthermore, the cylindrical latch device or the box type latch device are generally mechanical type that must be replaced if the door is intended to provide electric lock functions.

Thus, a need exists for a novel modularized electric latch control device that can be assembled into one of a plurality of different modes for cooperating with different types of latch devices.

BRIEF SUMMARY OF THE INVENTION

In a first aspect, a modularized electric latch control device includes:

a mounting seat including a first compartment having a first opening and a second opening;

an optional closure member;

an optional locking latch restraining frame;

an optional stopper;

an optional first escutcheon including a first outlet smaller than the first opening;

an optional second escutcheon including a second outlet substantially identical to the first opening;

a locking cap device pivotably connected to the mounting seat and fixably mounted to the mounting seat, wherein when the locking cap device is not fixed, the locking cap device is pivotable relative to the mounting seat between a closure position closing the second opening and a non-closure position not closing the second opening, and wherein when the locking cap device is fixed, the locking cap device is not pivotable from the closure position to the non-closure position;

the electric latch control device is selectively assembled into a first mode, a second mode, or a third mode, wherein when the electric latch control device is selectively assembled into the first mode, the optional first escutcheon is selected and coupled with the mounting seat and covers a portion of the first opening, and the first outlet is aligned with the first opening, wherein when the electric latch control device is selectively assembled into the second mode, the second escutcheon is selected and coupled with the mounting seat, the second outlet is aligned with the first opening, the closure member and the stopper are selected and mounted in the first compartment, each of the closure member and the stopper blocks a portion of the first compartment, and wherein the closure member and the stopper are aligned with the second outlet of the second escutcheon;

wherein when the electric latch control device is selectively assembled into the third mode, the second escutcheon is selected and coupled with the mounting seat, the second outlet is aligned with the first opening, the locking latch restraining frame and the stopper are selected and mounted in the first compartment, each of the locking latch restraining frame and the stopper blocks a portion of the first compartment, wherein the locking latch restraining frame defines a locking latch hole, and wherein the locking latch restraining frame and the stopper are aligned with the second outlet, wherein when the locking cap device is in the closure position, the closure member, the locking latch restraining frame, and the stopper are prevented from being detached from or mounted into the first compartment, and wherein when the locking cap device is in the non-closure position, the closure member, the locking latch restraining frame, and the stopper are permitted to be detached from or mounted into the first compartment.

In an example, the mounting seat further includes a track. The closure member includes an outer wall, a sidewall, and an assembling wall. The outer wall extends between the sidewall and the assembling wall. The sidewall includes a through-hole. The assembling wall includes an assembling hole aligned with the through-hole. When the closure member is selected and mounted, the sidewall of the closure member faces the locking cap device, the assembling hole is aligned with the track. When the locking cap device is in the non-closure position, the sidewall of the closure member is exposed to permit a screw to extend through the through-hole of the closure member, the assembling hole, and the track. A first nut is optionally coupled with the screw to fix the closure member in the first compartment. The screw is detachable from the first nut to permit detachment of the closure member from the first compartment.

In an example, the mounting seat further includes a track. The locking latch restraining frame includes an end wall and a mounting wall. The end wall includes a through-hole. The mounting wall includes a mounting hole aligned with the through-hole. When the locking latch restraining frame is selected and mounted, the end wall of the locking latch restraining frame faces the locking cap device, and the mounting hole is aligned with the track. When the locking cap device is in the non-closure position, the end wall of the locking latch restraining frame is exposed to permit a screw to extend through the through-hole of the locking latch restraining frame, the mounting hole, and the track. A first nut is optionally coupled with the screw to fix the locking latch restraining frame in the first compartment. The screw is detachable from the first nut to permit detachment of the locking latch restraining frame from the first compartment.

In an example, the track includes a receiving portion contiguous to a side of the mounting seat and spaced from the first compartment. The track further includes a through portion extending between the receiving portion and the first compartment. The through portion is smaller than the receiving portion, and wherein the first nut is received in the receiving portion of the track.

In an example, the stopper further includes an assembling end. The assembling end includes a protrusion configured to be received in the through portion of the track. When the locking cap device is in the non-closure position, the assembling end of the stopper is exposed to permit a screw to extend through the assembling end of the stopper and the track. A second nut is optionally coupled with the screw to fix the stopper in the first compartment. The screw is detachable from the second nut to permit detachment of the stopper from the first compartment.

In an example, the modularized electric latch control device further includes:

a detecting device adjustably mounted in the first compartment, wherein the mounting seat further includes a front face and a rear face spaced from the front face, wherein the mounting seat further includes first and second sides, extending between the front face and the rear face, wherein the first opening is located in the front face, wherein the second opening is located in the first side, wherein the mounting seat further includes a track formed on the second side and intercommunicating with the first compartment, wherein the track is located between the front face and the rear face, wherein the detecting device is movable along the track to adjust a desired location relative to the first compartment; and a detecting device adjustably mounted in the first compartment, wherein the mounting seat further includes a front face and a rear face spaced from the front face, wherein the mounting seat further includes first and second sides extending between the front face and the rear face, wherein the first opening is located in the front face, wherein the second opening is located in the first side, wherein the mounting seat further includes a track formed on the second side and intercommunicating with the first compartment, wherein the track is located between the front face and the rear face, wherein the detecting device is movable along the track to adjust a desired location relative to the first compartment; and an electric locking device, wherein the mounting seat further includes a second compartment in the rear face, wherein the electric locking device is mounted in the second compartment and is fixably connected to the locking cap device, and wherein the electric locking device is configured to lock the locking cap device in the closure position.

In an example, the detecting device further includes:

a supporting seat including a pivotal end, wherein a pivotal groove is defined in the pivotal end and includes a through-hole;

an actuation plate includes a lug pivotably connected to the pivotal end, wherein the lug includes an abutting face, wherein the actuation plate is pivotable relative to the supporting seat between a contact position and a non-contact position;

a pressing member movably received in the through-hole and abutting the abutting face of the actuation plate; and a closure detection member coupled to the supporting seat and contiguous to a side of the pressing member, wherein when the actuation plate is in the contact position, the pressing member 80 presses against the closure detection member, and wherein when the actuation plate is in the non-contact position, the pressing member does not press against the closure detection member.

In an example, the actuation plate further includes a channel in the abutting face. The pressing member is outside of the channel when the actuation plate is in the contact position. The pressing member is in the channel when the actuation plate is in the non-contact position.

In an example, the locking cap device further includes a locking cap having an inner side pivotably connected to the mounting seat. The locking cap further includes a first coupling portion formed on the inner side and extending into the second compartment. The locking cap further includes a second coupling portion spaced from the first coupling portion and located in the second compartment.

The electric locking device further includes:

a bracket including an engaging wall having an engaging slot, wherein the engaging slot has a first end and a second end, wherein the seat includes an engaging portion between the first compartment and the second compartment, wherein the bracket is selectively engaged with the engaging portion in a first position or a second position, wherein in the first position, the first end of the engaging slot of the bracket is coupled with the engaging portion, and wherein in the second position, the second end of the engaging slot of the bracket is coupled with the engaging portion;

a driving member fixed on the bracket; and a locking member coupled to and jointly movable with the driving member, wherein the locking member includes an insertion groove corresponding to the first coupling portion, wherein the driving member moves the locking member to an extended position or a retracted position, wherein when the bracket is in the first position and the locking member is in the extended position, the insertion groove of the locking member is coupled with the first coupling portion, the locking cap device is locked and is prevented from pivoting from the closure position to the non-closure position, wherein when the bracket is in the first position and the locking member is in the retracted position, the locking member is located between the first coupling portion and the second coupling portion, the locking cap device is unlocked and is pivotable from the closure position to the non-closure position, wherein when the bracket is in the second position and the locking member is in the extended position, the locking member is located between the first coupling portion and the second coupling portion, the locking cap device is unlocked and is pivotable from the closure position to the non-closure position, and wherein when the bracket is in the second position and the locking member is in the retracted position, the insertion groove of the locking member is coupled with the second coupling portion, the locking cap device is locked and is prevented from pivoting from the closure position to the non-closure position.

In an example, the locking cap device further includes:

a locking cap pivotably connected to the mounting seat, wherein the locking cap includes an inner face, wherein the inner face faces the first compartment when the locking cap is in the closure position;

a guiding plate detachably mounted to the inner face of the locking cap, wherein the guiding plate includes a first face and a second face, wherein the guiding plate further includes a guiding groove extending from the first face through the second face, and wherein the second face of the guiding plate faces the inner face of the locking cap;

a connecting member;

a second screw extending from the second face through the guiding slot of the guiding plate and threadedly engaged with the connecting member to detachably mount the connecting member to the first face of the guiding plate;

an optional first lining member;

an optional second lining member, wherein the first Lining member has a thickness larger than a thickness of the second lining member; and an optional screw, wherein the connecting member is selectively and detachably coupled with a selected one of the first lining member and the second lining member by extending the screw through the selected one of the first lining member and the second lining member.

In an example, the guiding groove of the guiding plate includes an enlarged portion extending from the second face towards but spaced from the first face and a positioning portion extending between the enlarged portion and the first face. The positioning portion includes a surface having a plurality of protrusions and a plurality of recesses, with the protrusions and the recesses alternately disposed. The connecting member further includes an engaging block having a shape corresponding to the positioning portion. The engaging block of the connecting member is coupled to a selected position on the positioning portion of the guiding groove. The second screw has a head received in the enlarged portion of the guiding plate.

In a second aspect, a modularized electric latch control device includes:

a mounting seat having a first compartment with a first opening and a second opening;

an optional closure member;

an optional locking latch restraining frame;

an optional stopper;

an optional first escutcheon including a first outlet smaller than the first opening;

an optional second escutcheon including a second outlet substantially identical to the first opening;

a locking cap device pivotably connected to the mounting seat and fixably mounted to the mounting seat, wherein when the locking cap device is not fixed, the locking cap device is pivotable relative to the mounting seat between a closure position closing the second opening and a non-closure position not closing the second opening, and wherein when the locking cap device is fixed, the locking cap device is not pivotable from the closure position to the non-closure position;

an optional cylindrical latch device having a latch;

an optional first box type latch device including a first latch and a first anti-pick latch operatively connected to the first latch, wherein the first latch is retractable when the first anti-pick latch is in an extended position, and wherein the first latch is not retractable when the first anti-pick latch is in a retracted position;

an optional second box type latch device including a second latch and a second anti-pick latch operatively connected to the second latch, wherein the second latch is retractable when the second anti-pick latch is in an extended position, wherein the second latch is not retractable when the second anti-pick latch is in a retracted position;

the electric latch control device is selectively assembled into a first mode, a second mode, or a third mode to couple with the cylindrical latch device, the first box type latch device, or the second box type latch device, wherein when the electric latch control device is selectively assembled into the first mode, the optional first escutcheon is selected and coupled with the mounting seat and covers a portion of the first opening, and the first outlet is aligned with the first opening, wherein the first compartment receives the latch of the cylindrical latch device, wherein the latch of the cylindrical latch device is prevented from disengaging from the first compartment when the locking cap device is locked, wherein when the locking cap device is unlocked, the locking cap device is actuatable by the latch of the cylindrical latch device to pivot from the closure position to the non-closure position to thereby disengage from the first compartment, wherein when the electric latch control device is selectively assembled into the second mode, the second escutcheon is selected and coupled with the mounting seat, the second outlet is aligned with the first opening, the closure member and the optional stopper are selected and mounted in the first compartment, each of the closure member and the stopper blocks a portion of the first compartment, wherein the closure member and the stopper are aligned with the second outlet of the second escutcheon, wherein the first compartment receives the first latch of the first box type latch device, wherein the stopper is configured to press and retract the first anti-pick latch, wherein the first latch of the first box type latch device is prevented from disengaging from the first compartment when the locking cap device is locked, and wherein when the locking cap device is unlocked, the locking cap device is actuatable by the first latch of the first box type latch device to pivot from the closure position to the non-closure position to thereby disengage from the first compartment, wherein when the electric latch control device is selectively assembled into the third mode, the second escutcheon is selected and coupled with the mounting seat, the second outlet is aligned with the first opening, the locking latch restraining frame and the stopper are selected and mounted in the first compartment, each of the locking latch restraining frame and the stopper blocks a portion of the first compartment, wherein the locking latch restraining frame defines a locking latch hole, wherein the locking latch restraining frame and the stopper are aligned with the second outlet of the second escutcheon, wherein the first compartment receives the second latch of the second box type latch device, wherein the stopper is configured to press and retract the second anti-pick latch, wherein the locking latch hole of the locking latch restraining frame is configured to receive the locking latch of the second box type latch device, wherein the second latch of the second box type latch device is prevented from disengaging from the first compartment when the locking cap device is locked, wherein the second latch of the second box type latch device is prevented from disengaging from the first compartment when the locking cap device is unlocked and the locking latch of the second box type latch device is received in the locking latch hole of the locking latch restraining frame, and wherein when the locking cap device is unlocked and the locking latch of the second box type latch device is outside of the locking latch hole of the locking latch restraining frame, the locking cap device is actutable by the second latch of the second box type latch device to pivot from the closure position to the non-closure position to thereby disengage from the first compartment, wherein when the locking cap device is in the closure position, the closure member, the locking latch restraining frame, and the stopper are prevented from being detached from or mounted into the first compartment, and wherein when the locking cap device is in the non-closure position, the closure member, the locking latch restraining frame, and the stopper are permitted to be detached from or mounted into the first compartment.

In an example, the mounting seat further includes a track. The locking latch restraining frame includes an end wall and a mounting wall. The end wall includes a through-hole. The mounting wall includes a mounting hole aligned with the through-hole, when the locking latch restraining frame is selected and mounted, the end wall of the locking latch restraining frame faces the locking cap device, and the mounting hole is aligned with the track. When the locking cap device is in the non-closure position, the end wall of the locking latch restraining frame is exposed to permit a screw to extend through the through-hole of the locking latch restraining frame, the mounting hole, and the track. A first nut is optionally coupled with the screw to fix the locking latch restraining frame in the first compartment. The screw is detachable from the first nut to permit detachment of the locking latch restraining frame from the first compartment.

In an example, the track includes a receiving portion contiguous to a side of the mounting seat and spaced from the first compartment. The track further includes a through portion extending between the receiving portion and the first compartment. The through portion is smaller than the receiving portion. The first nut is received in the receiving portion of the track.

In an example, wherein the detecting device includes a supporting seat, an actuation plate, a pressing member, and a closure detection member. The supporting seat includes a pivotal end. A pivotal groove is defined in the pivotal end and includes a through-hole. The actuation plate includes a lug pivotably connected to the pivotal end. The lug includes an abutting face. The actuation plate is pivotable relative to the supporting seat between a contact position and a non-contact position. The pressing member is movably received in the through-hole and abutting the abutting face of the actuation plate. The closure detection member is coupled to the supporting seat and contiguous to a side of the pressing member. When one of the latch of the cylindrical latch device, the first latch of the first box type latch device, and the second latch of the second box type latch device is located in the first compartment and when the actuation plate is in the contact position, the pressing member presses against the closure detection member. When one of the latch of the cylindrical latch device, the first latch of the first box type latch device, and the second latch of the second box type latch device is located in the first compartment and when the actuation plate is in the non-contact position, the pressing member does not contact the closure detection member.

The present invention will become clearer in light of the following detailed description of illustrative embodiments of this invention described in connection with the drawings.

Figure 1:
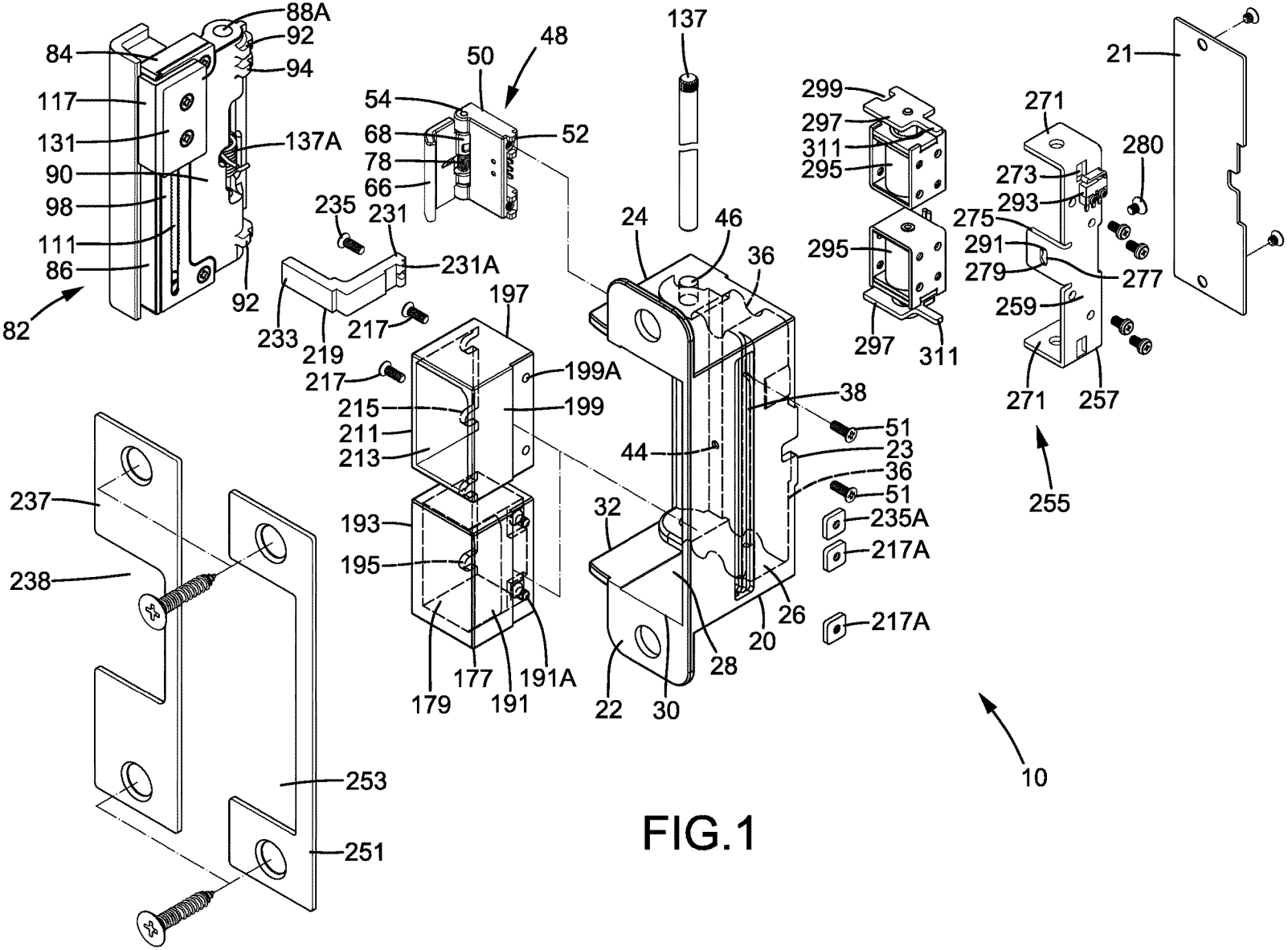
FIG. 1 is an exploded, perspective view of a modularized electric latch control device according to the present invention.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "lower", "upper", "inner", "outer", "side", "end", "portion", "longitudinal", "axial", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

With reference to the drawings, a modularized electric latch control device 10 (hereinafter referred to as "electric latch control device 10") according to the present invention can be can be assembled into different modes according to different needs.

The electric latch control device 10 includes a mounting seat 20 having a front face 22 and a rear face 23 spaced from the front face 22. The mounting seat 20 further includes first and second sides 24 and 26 extending between the front face 22 and the rear face 23 and spaced from each other (FIG. 1). The mounting seat 20 further includes a first compartment 28 extending from the front face 22 towards but spaced from the rear face 23 and a second compartment 36 extending from the rear face 23 towards the first compartment 28 and intercommunicating with the first compartment 28. An engaging portion 44 is defined between the first compartment 28 and the second compartment 36. The mounting seat 20 further includes a pivot hole 46 in an intersection of the first compartment 28 and the second compartment 36. The mounting seat 20 further includes a track 38 that is elongated and that extends from the second side 26 to the first compartment 28. The track 38 includes a receiving portion 40 contiguous to the second side 26 and spaced from the first, compartment 28. The track 38 further includes a through portion 42 extending between the receiving portion 40 and the first compartment 28. The through portion 42 is smaller than the receiving portion 40. The mounting seat 20 further includes a first opening 30 defined in the front face 22 and intercommunicating with the first compartment 28. The mounting seat 20 further includes a second opening 32 defined in the first side 24, contiguous to the first opening 30, and intercommunicating with the first compartment 28. The mounting seat 20 is configured to be mounted on an end face of a door frame (not shown).

Figure 2:
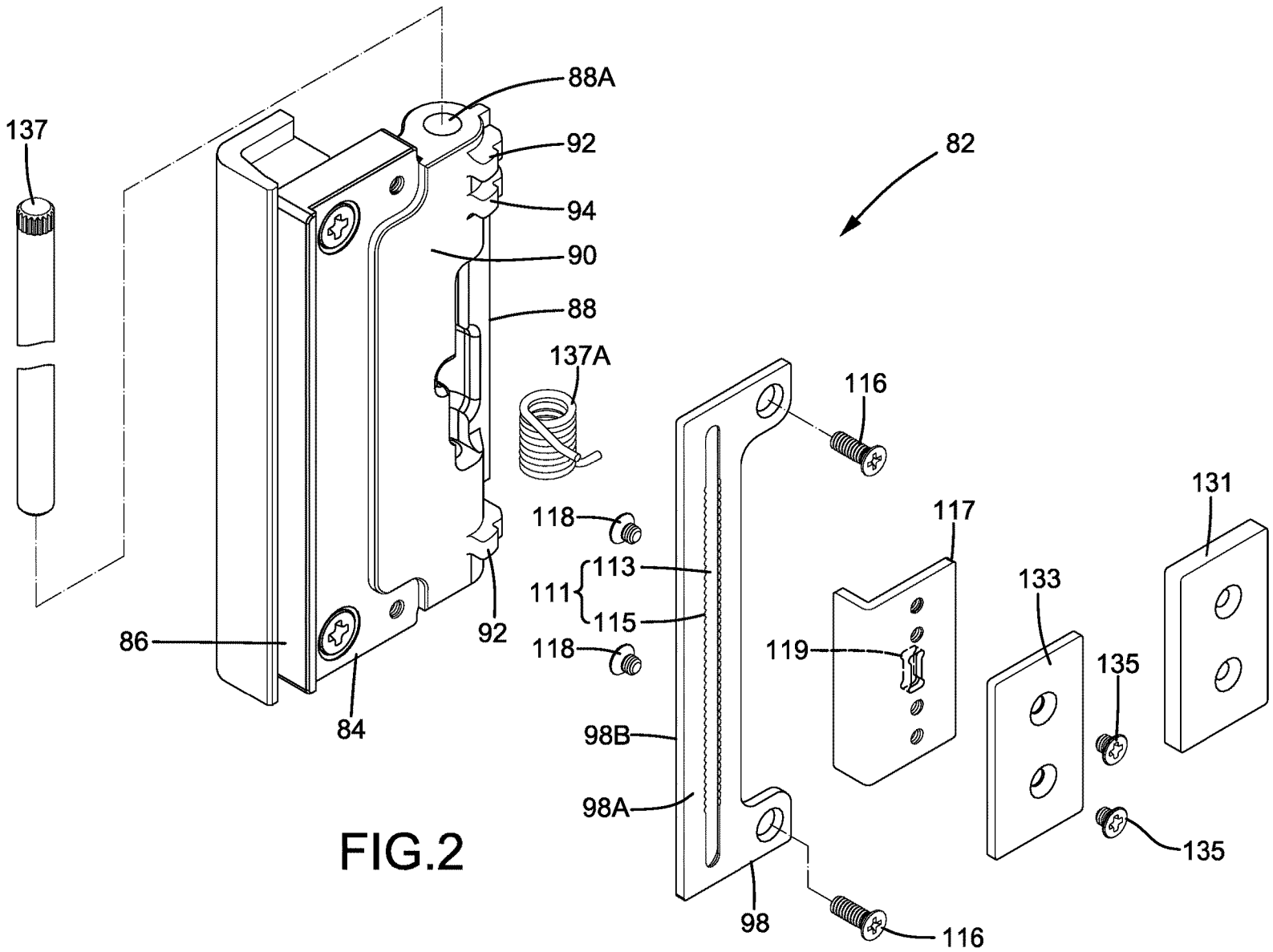
FIG. 2 is an exploded, perspective view of a locking cap device of the modularized electric latch control device of FIG. 1.

With reference to FIG. 2, the electric latch control device 10 further includes a locking cap device 82 pivotably connected to the mounting seat 20. The locking cap device 82 includes a locking cap 84 having an outer side 86 and an inner side 88. The locking cap 84 further includes an inner face 90 extending between the outer side 86 and the inner side 88. The locking cap 84 further includes two first coupling portions 92 disposed on two ends of an edge of the inner side 88 and arranged in the form of two protrusions in this embodiment. The locking cap 84 further includes a second coupling portion 94 between the two first coupling portions 92. The locking cap 84 further includes a pivotal hole 88A defied in the inner side 88.

Figure 5:
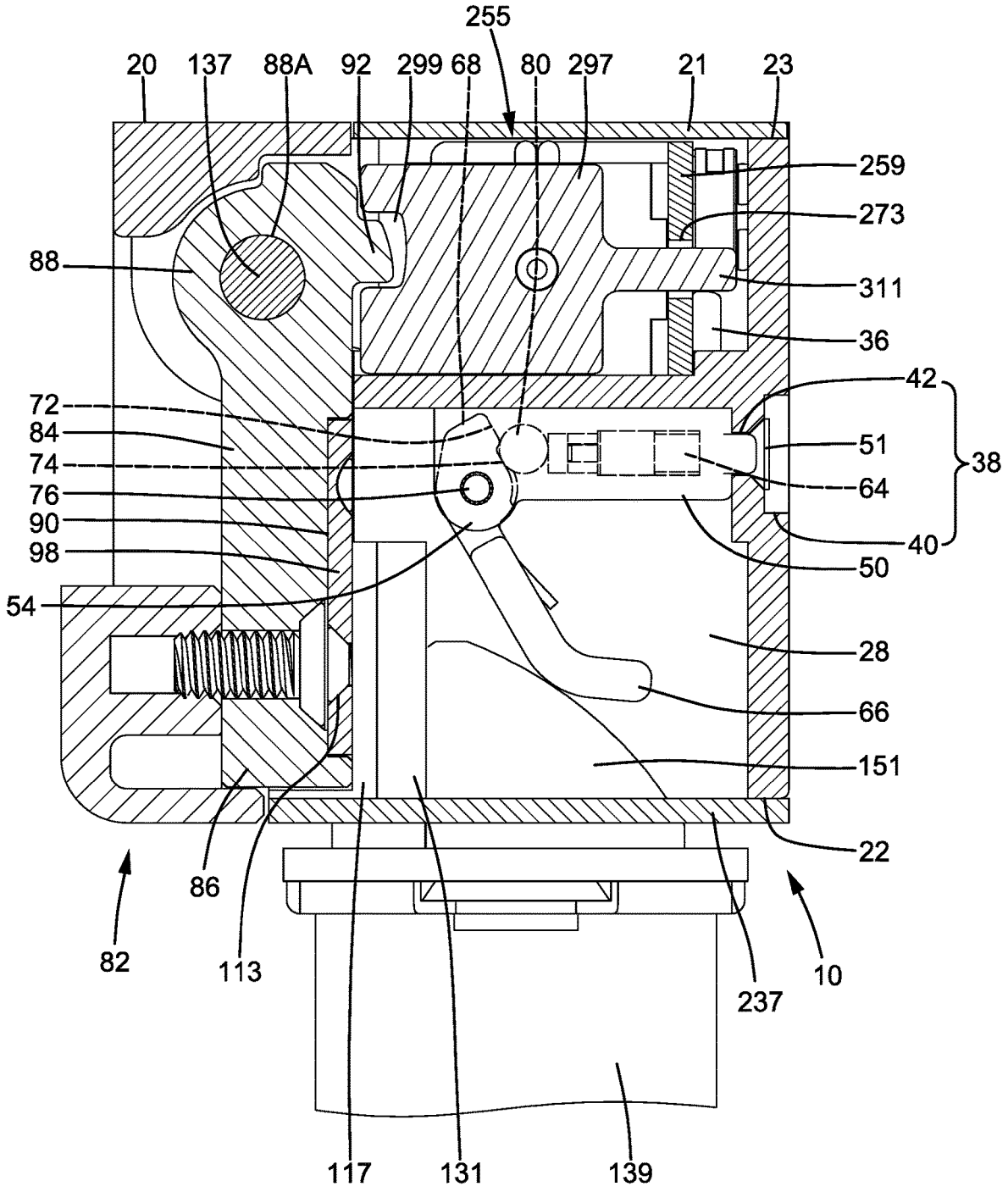
FIG. 5 is a cross sectional view taken along section line 5-5 of FIG. 4 after assembly.
Figure 6:
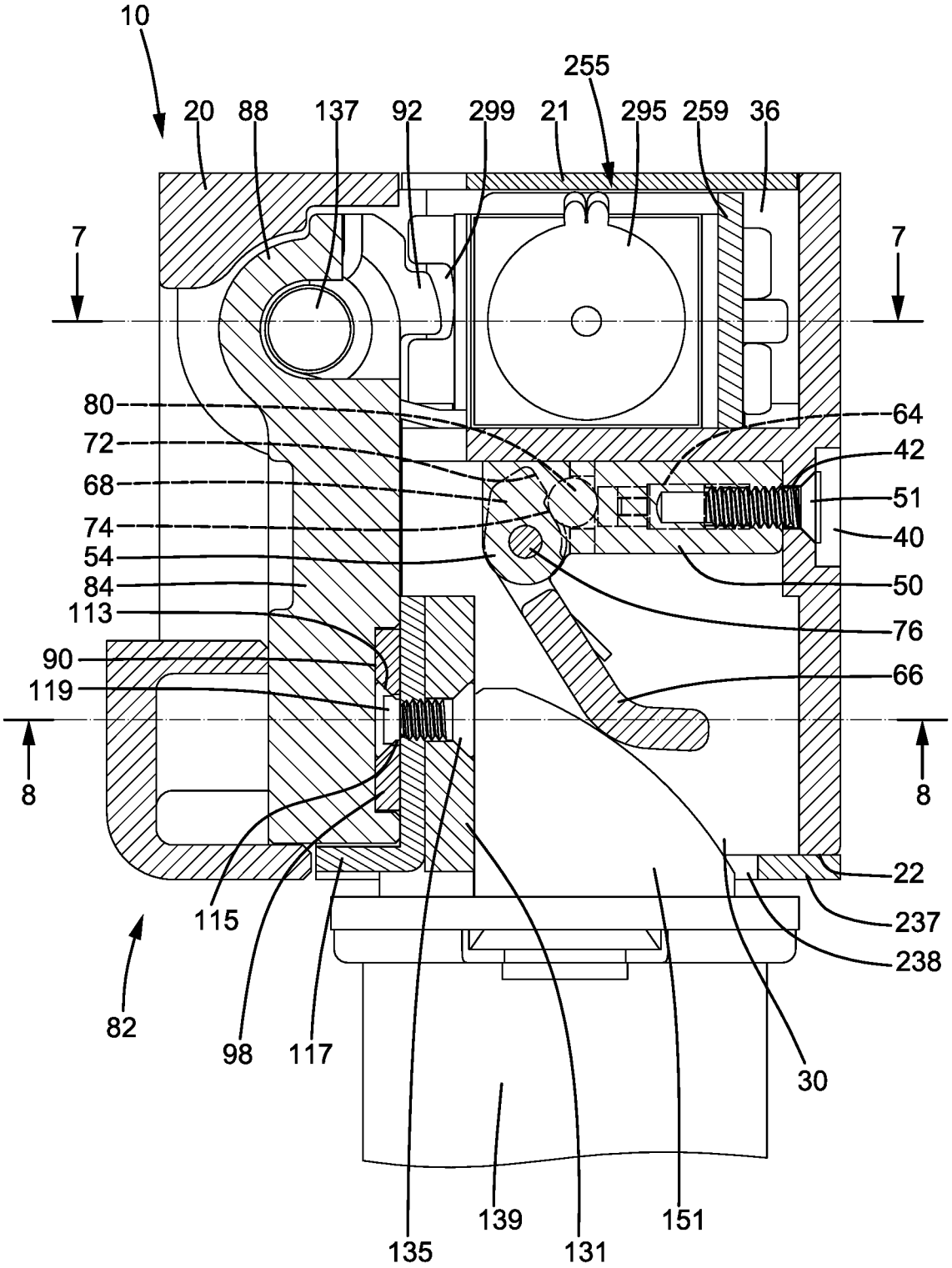
FIG. 6 is a cross sectional view taken along section line 6-6 of FIG. 4 after assembly.
Figure 7:
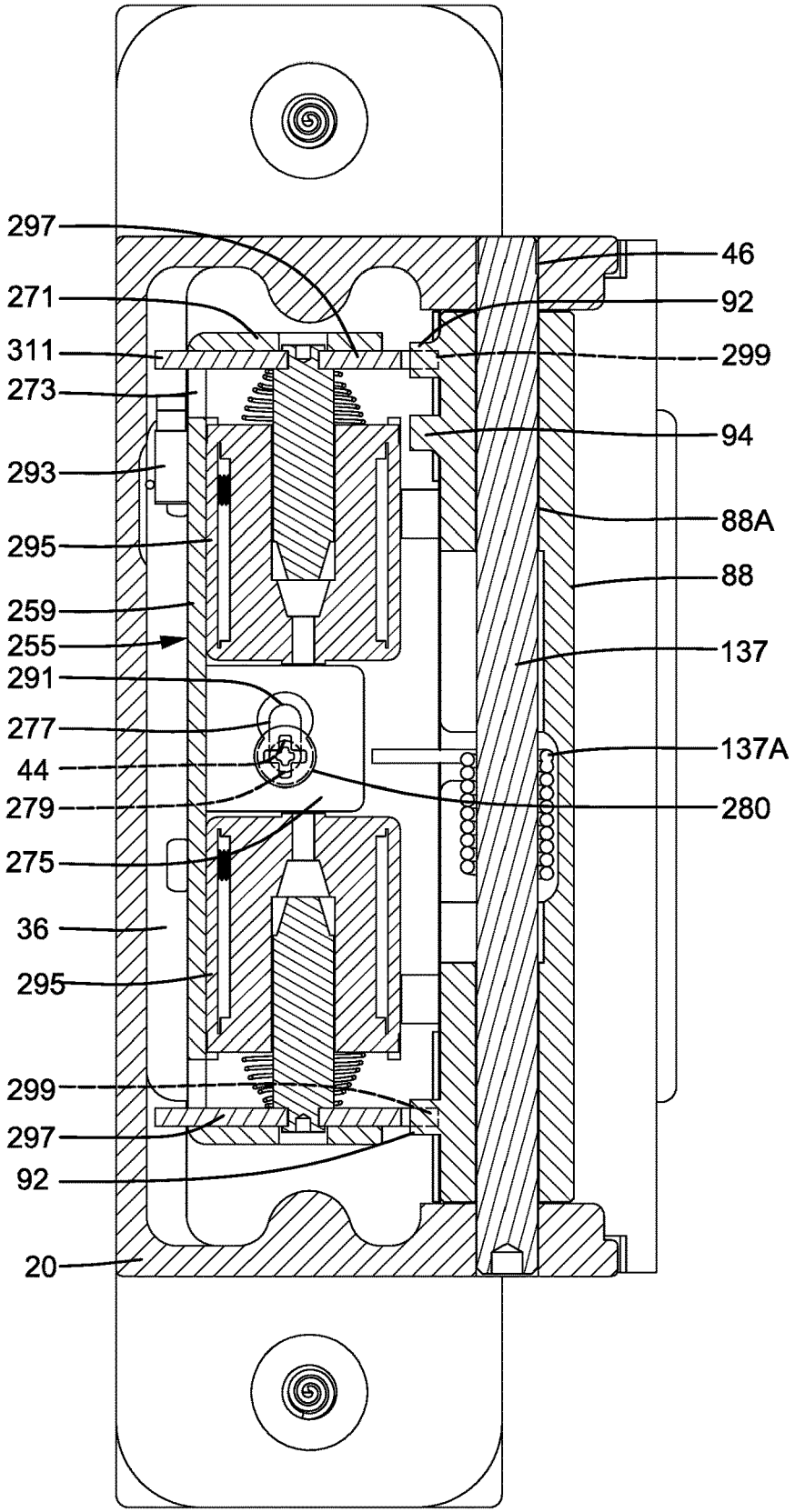
FIG. 7 is a cross sectional view taken along section line 7-7 of FIG. 6.
Figure 10:
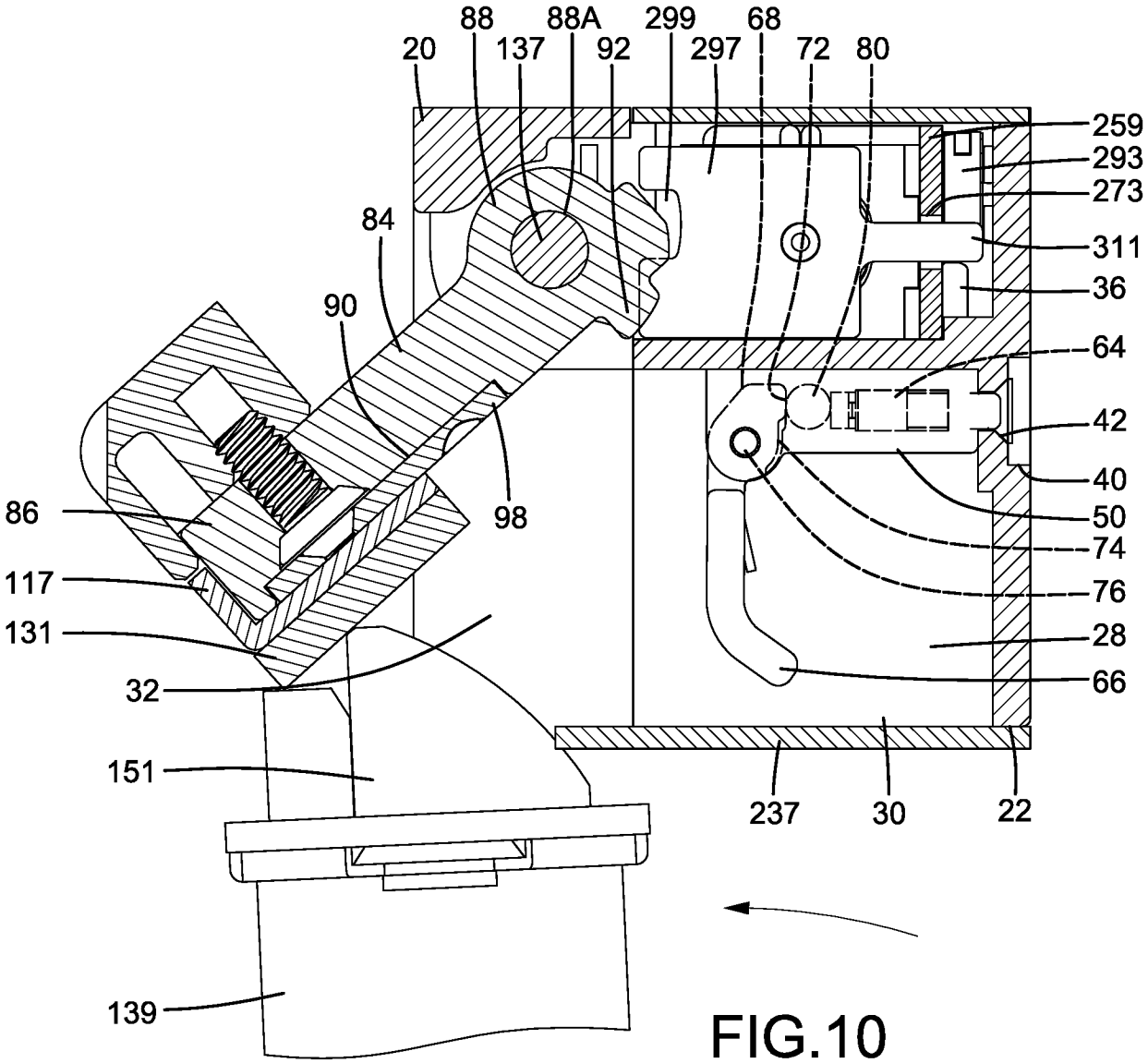
FIG. 10 is a view similar to FIG. 5 with the locking cap device pushed by a cylindrical latch device to a non-closure position.
Figure 18:
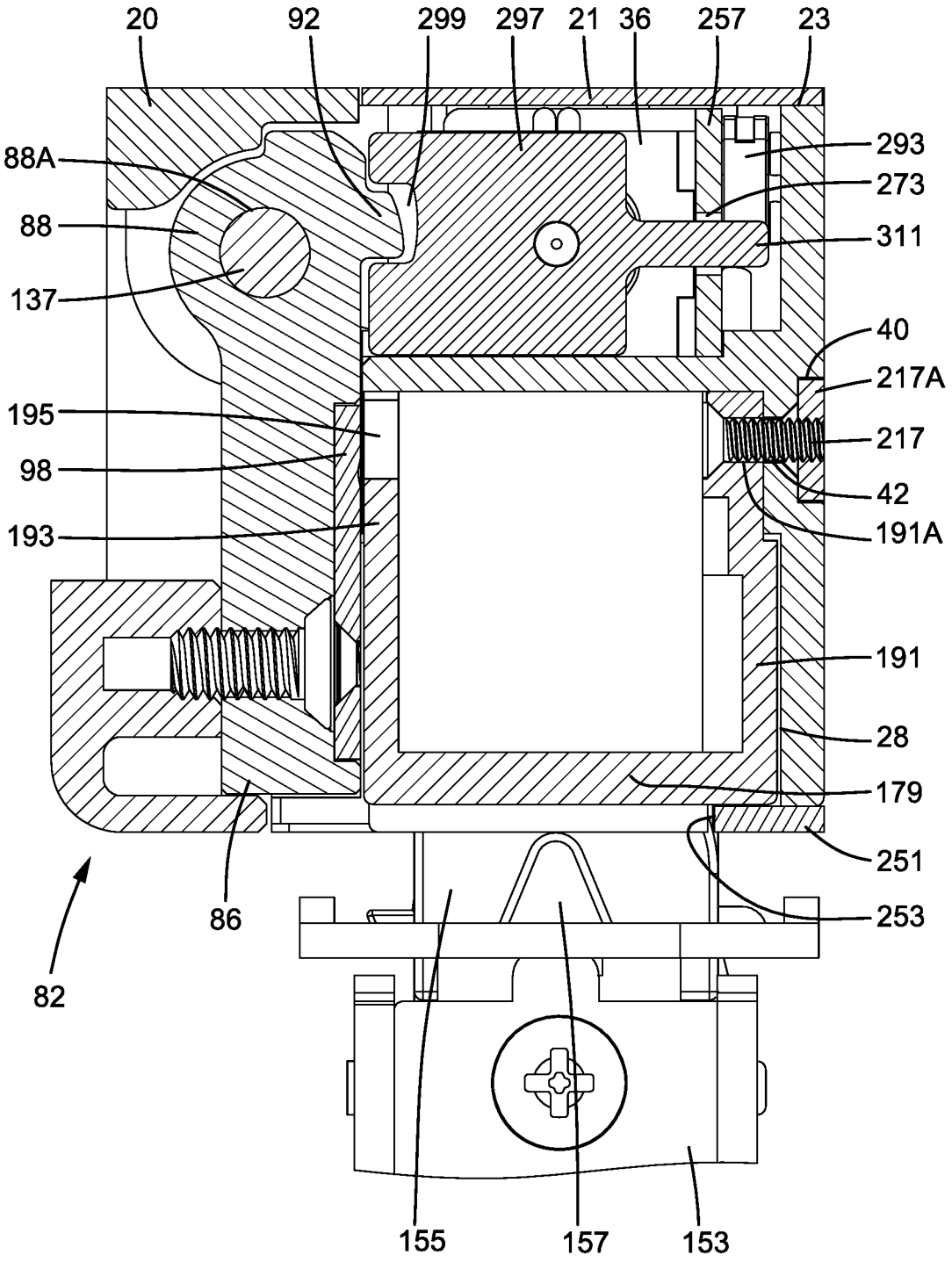
FIG. 18 is a cross sectional view taken along section line 18-18 of FIG. 17.

The pivotal hole 88A of the locking cap 84 is aligned with the pivot hole 46 of the mounting seat 20. The inner face 90 faces the first compartment 28. A pivot 137 extends through the pivot hole 46 and the pivotal hole 88A (FIGS. 6 and 7). Thus, the locking cap 84 is pivotable relative to the mounting seat 20 between a closure position (FIGS. 5 and 6) and a non-closure position (FIG. 10). When the locking cap 84 is in the closure position, the locking cap 84 closes the second opening 32, and the outer side 86 of the locking cap 84 is in the second opening 32. On the other hand, when the locking cap 84 is in the non-closure position, the locking cap 84 reveals the second opening 32 (FIGS. 10 and 18). A return spring 137A is mounted around the pivot 137 and is located between the locking cap 84 and the mounting seat 20. The return spring 137A biases the locking cap 84 toward the closure position.

The locking cap device 82 further includes a guiding plate 98 detachably mounted to the locking cap 84. The guiding plate 98 includes a first face 98A and a second face 98B spaced from the first face 98A. The guiding plate 98 further includes a guiding groove III extending from the first face 98A through the second face 98B. The guiding groove 111 includes an enlarged portion 113 extending from the second face 98B towards but spaced from the first face 98A. The guiding groove 111 further includes a positioning portion 115 extending between the enlarged portion 113 and the first face 98A. The positioning portion 115 is smaller than the enlarged portion 113 (see FIG. 6). The positioning portion 115 includes a surface having a plurality of protrusions and a plurality of recesses, with the protrusions and the recesses alternately disposed. Two first screws 116 are used to detachably screw the guiding plate 98 to the inner face 90 of the locking cap 84.

Figure 8:
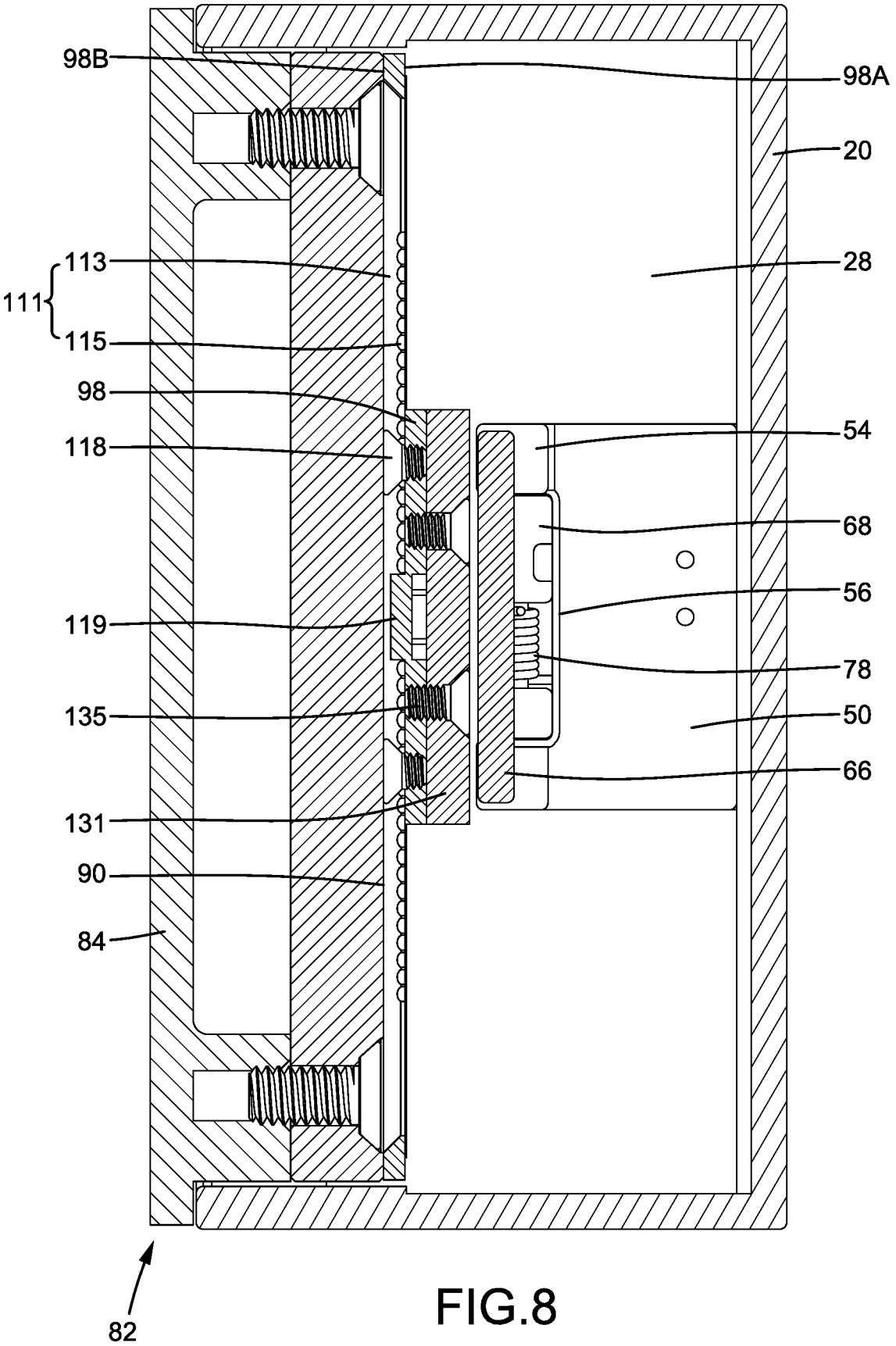
FIG. 8 is a cross sectional view taken along section line 8-8 of FIG. 6.

The locking cap device 82 further includes a connecting member 117 detachably mounted to a selective position on the first face 98A of the guiding plate 98. The connecting member 117 includes an engaging block 119 corresponding to the shape of the positioning portion 115. The engaging block 119 is coupled to the selected position on the positioning portion 115 of the guiding groove 111. After the engaging block 119 of the connecting member 117 and the positioning portion 115 of the guiding grove 111 are coupled with each other, due to the protrusions and recesses on each of the engaging block 119 and the positioning member 115, the position of the connecting member 177 relative to the guiding plate 98 is fixed, and two second screws 118 extend through the guiding groove 111 into the connecting member 117 (FIG. 8) to fix the connecting member 117 to the selected position on the guiding plate 98.

After the connecting member 117 is fixed to the guiding plate 98, the guiding plate 98 is mounted to the inner face 90 of the locking cap 84. Specifically, the second face 98B abuts the inner face 90 of the locking cap 84. Then, screws are used to fix the guiding plate 98.

The locking cap device 82 further includes an optional first lining member 131 and an optional second lining member 133 having a thickness smaller than a thickness of the first lining member 131. One of the first lining member 131 and the second lining member 133 is selectively and securely mounted to the connecting member 117 by extending two screws 135 through the first lining member 131 or the second lining member 133 (FIGS. 6 and 16) according to the type of the latch device for cooperating with the electric latch control device 10.

With reference to FIG. 1, the electric latch control device 10 further includes a closure member 177, an optional locking latch restraining frame 197, an optional stopper 219, an optional first escutcheon 237, and an optional second escutcheon 251. The closure member 177 includes an outer wall 179, a sidewall 193, and an assembling wall 191. The outer wall 179 extends between the sidewall 193 and the assembling wall 191. The sidewall 193 includes two through-holes 195. The assembling wall 191 includes two assembling holes 191A respectively aligned with the two through-holes 195.

The locking latch restraining frame 197 includes an end wall 211 and a mounting wall 199 spaced from the end wall 211. The end wall 211 has two through-holes 215. The mounting wall 199 has two assembling holes 199A respectively aligned with the two through-holes 215. The locking latch restraining frame 197 defines a locking latch hole 213. The stopper 219 is a substantially L-shaped member having a stopping end 233 and an assembling end 231. The assembling end 231 includes a protrusion 231A received in the through portion 42 of the track 38.

One of the first escutcheon 237 and the second escutcheon 251 is selectively mounted to the front face 22 of the mounting seat 20. As shown in FIG. 1, the first escutcheon 237 includes a first outlet 238 smaller than the first opening 30. The first outlet 238 is open in an edge of the first escutcheon 237. The second escutcheon 251 includes a second outlet 253 larger than the first outlet 238 and substantially equal to the first opening 30. The second outlet 253 is open in an edge of the second escutcheon 251.

Figure 3:
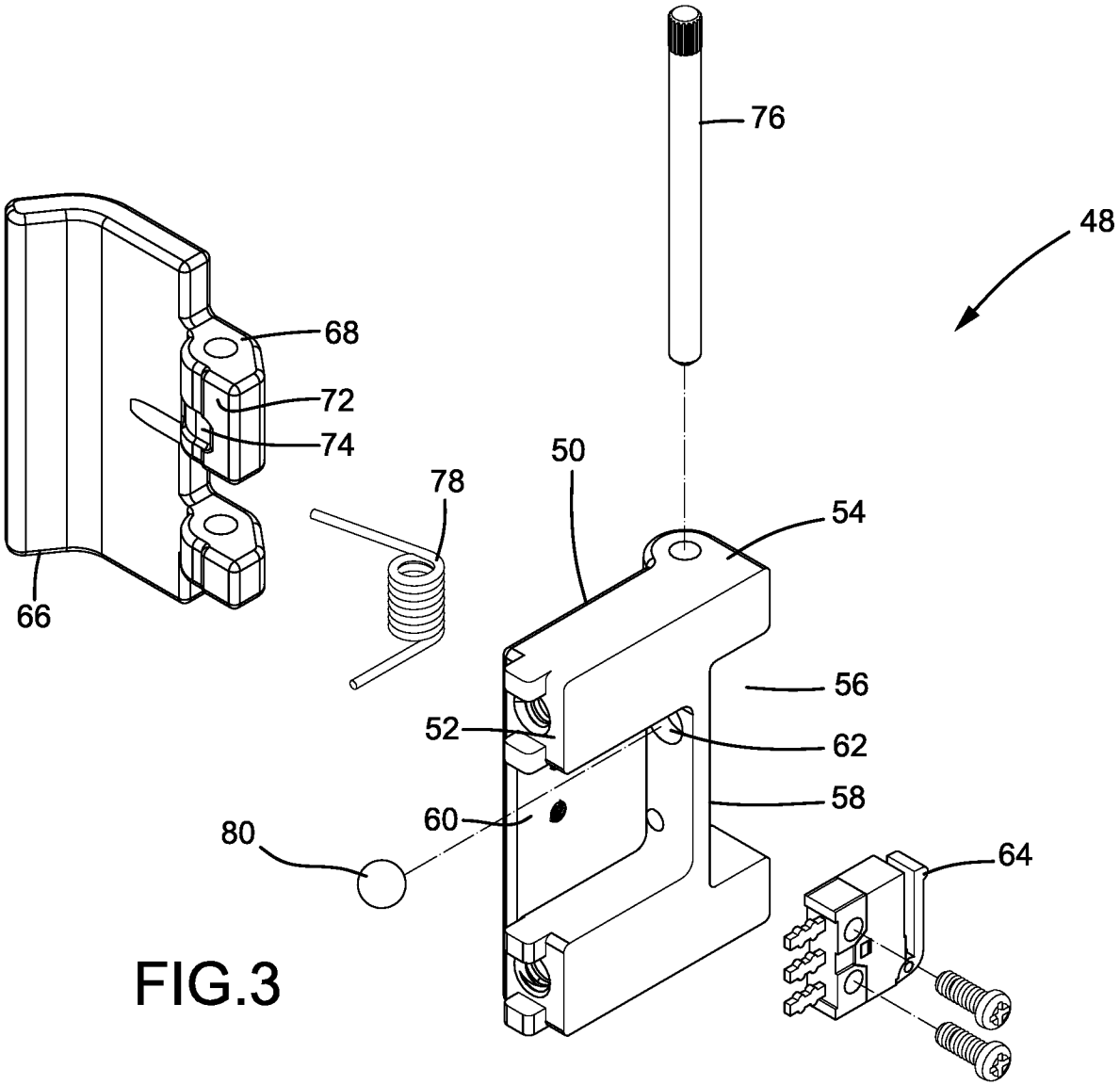
FIG. 3 is an exploded, perspective view of a detecting device of the modularized electric latch control device of FIG. 1.
Figure 4:
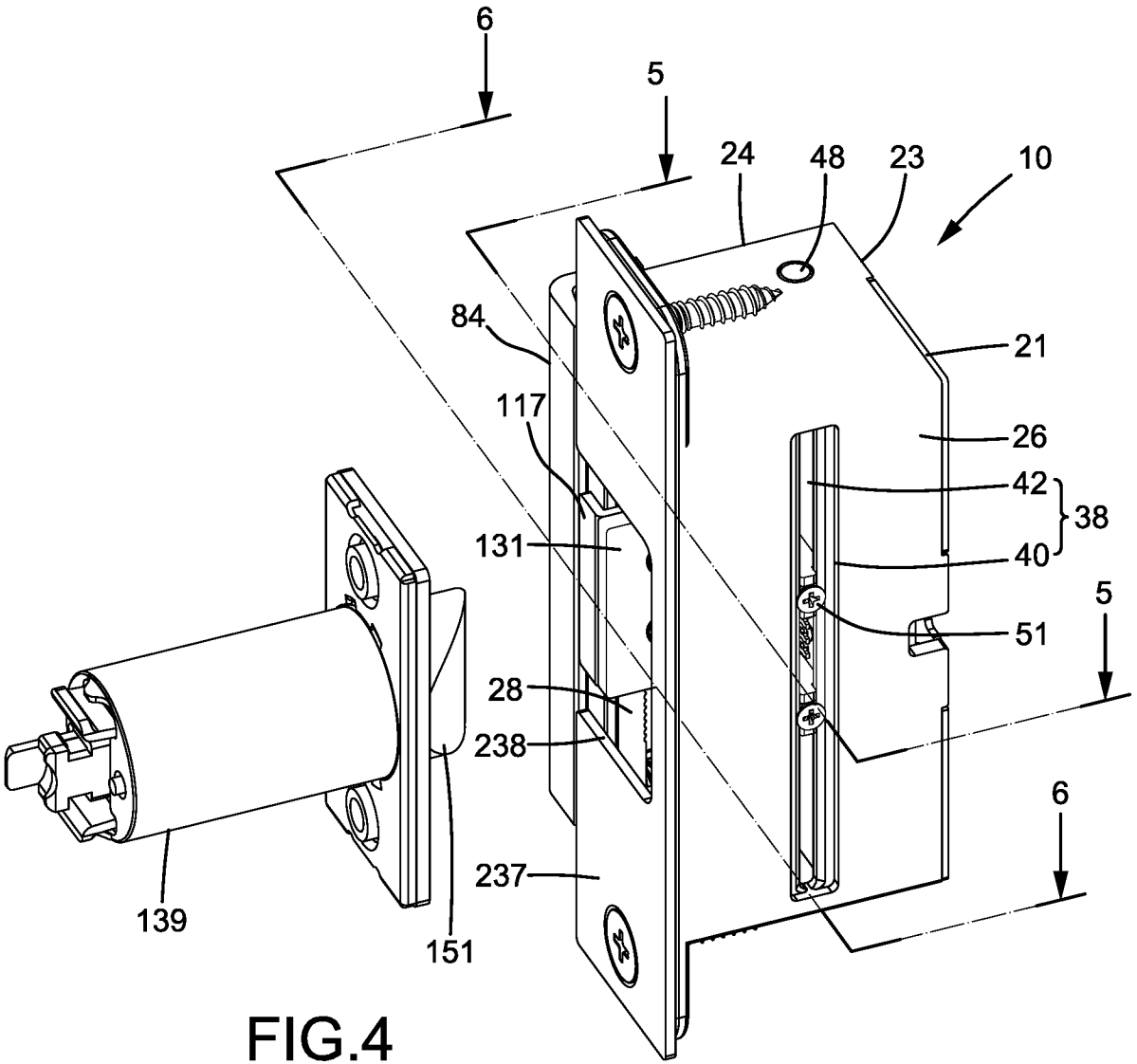
FIG. 4 is a perspective view of the modularized electric latch control device assembled into a first mode for cooperating with a cylindrical latch device.

With reference to FIG. 3, the electric latch control device 10 further includes a detecting device 48 received in the first compartment 28. The detecting device 48 includes a supporting seat 50 having a coupling end 52 and a pivotal end 54 spaced from the coupling end 52. The supporting seat 50 further includes a pivotal groove 56 in the pivotal end 54 and a recess 60 spaced from the pivotal groove 56 and extending to the coupling end 52. A through-hole 62 extends from a bottom wall 58 of the pivotal groove 56 to the recess 60.

The detecting device 48 further includes an actuation plate 66, a pressing member 80, and a closure detection sensor 64. The actuation plate 66 includes a lug 68 on a side thereof. The lug 68 includes an abutting face 72 and a channel 74 defined in the abutting face 72. The lug 68 of the actuation plate 66 is received in the pivotal groove 56 of the supporting seat 50. An axle 76 extends through the pivotal end 54 of the supporting seat 50 and the lug 68, such that the actuating plate 66 is pivotable relative to the supporting seat 50 to a non-contact position (FIG. 5) or a contact position (FIG. 10). A bias spring 78 is mounted around the axle 76 and is located between the actuation plate 66 and the supporting seat 50. The bias spring 78 biases the actuating plate 66 to the non-contact position.

The closure detection sensor 64 is comprised of a micro switch, is fixed in the recess 60, and is aligned with the through-hole 62. The pressing member 80 is in the form of a ball in this embodiment, is received in the through-hole 62, and is located between the closure detection sensor 64 and the lug 68 of the actuation plate 66. With reference to FIG. 5, when the actuation plate 66 is in the non-contact position, the pressing member 80 is in the channel 74 without contacting and pressing the closure detection sensor 64. With reference to FIG. 10, when the actuation plate 66 is in the contact position, the pressing member 80 is outside of the channel 74, and the lug 68 of the actuation plate 66 contacts and presses against the closure detection sensor 64.

The detecting device 48 is received in the first compartment 28. The coupling end 52 of the supporting seat 50 of the detecting device 48 is aligned with the track 38 of the mounting seat 20 (FIG. 6). The detecting device 48 is movable along the track 38 to a desired position. Then, two fasteners 51 extend through the track 38 to threadedly connect the coupling end 52 of the supporting seat 50. Thus, the detecting device 48 is fixed to the selected position according to the type of latch device cooperating with the electric latch control device 10.

The electric latch control device 10 further includes an electric locking device 255 received in the second compartment 36. The electric locking device 255 includes a bracket 257 having a longitudinal wall 259 and two end walls 271 on two opposite ends of the longitudinal wall 259. Each of the two opposite ends of the longitudinal wall 259 includes a through-hole 273. The bracket 257 further includes an engaging wall 275 extending from a side of the longitudinal wall 259 and located between the two end walls 271. The engaging wall 275 includes an engaging slot 277 having a first end 279 and a second end 291 spaced from the first end 279.

The electric latch control device 10 further includes two driving members 295 mounted on the bracket 257 and two locking members 297 respectively driven by the two driving members 295. The two driving members 295 can be electromagnetic valves. Each of the two locking members 297 includes an insertion groove 299 and an activation end 311 spaced from the insertion groove 299. Each locking member 297 is coupled to one of the two driving members 295. Thus, each of the two driving members 295 can drive a respective locking member 297 between a retracted position (FIG. 9) and an extended position (FIG. 7). The two driving members 295 are fixed to the longitudinal wall 259 and are respectively adjacent to the two end walls 271. The activation end 311 of each of the two driving members 297 extends through a respective through-hole 273. A status sensor 293 is disposed on the longitudinal wall 259 and is located adjacent to the activation end 311 of one of the two driving members 297.

Through use of the bracket 257 and the engaging portion 44 of the mounting seat 20, the electric locking device 255 is selectively mounted by a screw 280 to a first position (FIG. 7) on the first end 279 of the engaging slot 277 aligned with the engaging portion 44 or a second position (FIG. 12) on the second end 291 of the engaging slot 277 aligned with the engaging portion 44. When the electric locking device 255 is mounted to the first position, each locking member 297 is aligned with a respective first coupling portion 92 of the locking cap device 82. When the electric locking device 255 is mounted to the second position, each locking member 297 is misaligned from the respective first coupling portion 92 of the locking cap device 82. Furthermore, one of the two locking members 297 is located between the first and second coupling portions 92 and 94. Furthermore, a lid 21 is mounted to the rear face 23 of the mounting seat 20 to close the second compartment 36.

Through adjustment and locations of the components in the first compartment 28, the electric latch control device 10 can be assembled into one of a plurality of different modes for cooperating with different types of latch devices. With reference to FIGS. 4-8, in a case that the electric latch control device 10 is assembled into a first mode, the electric locking device 255 is installed in a first position that is normally closed (FIG. 7).

Since the cylindrical latch device 139 includes only one latch 151, the closure member 177, the locking latch restraining frame 197, and the stopper 219 are not mounted in the first compartment 28. Thus, the first compartment 28 only receives the detecting device 48. Furthermore, the first escutcheon 237 is mounted to cooperate with the cylindrical latch device 139 (see FIG. 4), and the first outlet 238 of the first escutcheon 237 is substantially located in a center of the first opening 30. Furthermore, the first opening 30 is partially covered by the first escutcheon 237. Since the size of the first outlet 238 is slightly larger than the latch 151 of the cylindrical latch device 139, the latch 151 is permitted to pass through the first outlet 238 into the first compartment 28. Furthermore, since the latch 151 is located in the center of the first compartment 28, after loosening the fasteners 51, the detecting device 48 can be adjusted to a position substantially in the center of the first compartment 28 and aligns with the first outlet 238 of the first escutcheon 237 (FIG. 6), and the fasteners 51 are retightened to fix the detecting device 48.

Furthermore, after the guiding plate 98 is detached, the position of the connecting member 117 can be adjusted to align with the detecting device 48, and the guiding plate 98 is remounted to the connecting member 117. Furthermore, the first lining member 131 having a larger thickness is mounted to the connecting member 117 in response to the size of the latch 151 of the cylindrical latch device 139.

With reference to FIGS. 5 and 6, when the door is closed, the latch 151 of the cylindrical latch device 139 is received in the first compartment 28 of the mounting seat 20. The actuation plate 66 is pressed by the latch 151 to the non-contact position. The pressing member 80 does not touch the closure sensor 64. Thus, the door is detected to be in the closed position.

Assuming that the latch 151 of the cylindrical latch device 139 is in the first compartment 28 and the locking cap device 82 is in the closure position, when the locking member 297 of the electric locking device 255 is in the extended position, the insertion groove 299 of each of the two locking members 297 is engaged with a respective first insertion groove 92, such that the locking cap device 82 is locked by the electric locking device 255 and, thus, cannot move from the closure position to the non-closure position. The latch 151 of the cylindrical latch device 139 is restrained by the first lining member 131 cooperating with the first outlet 238 of the first escutcheon 237. Furthermore, the latch 151 of the cylindrical latch device 139 cannot disengage from the first compartment 28. Accordingly, the door is locked and, thus, cannot be opened.

Figure 9:
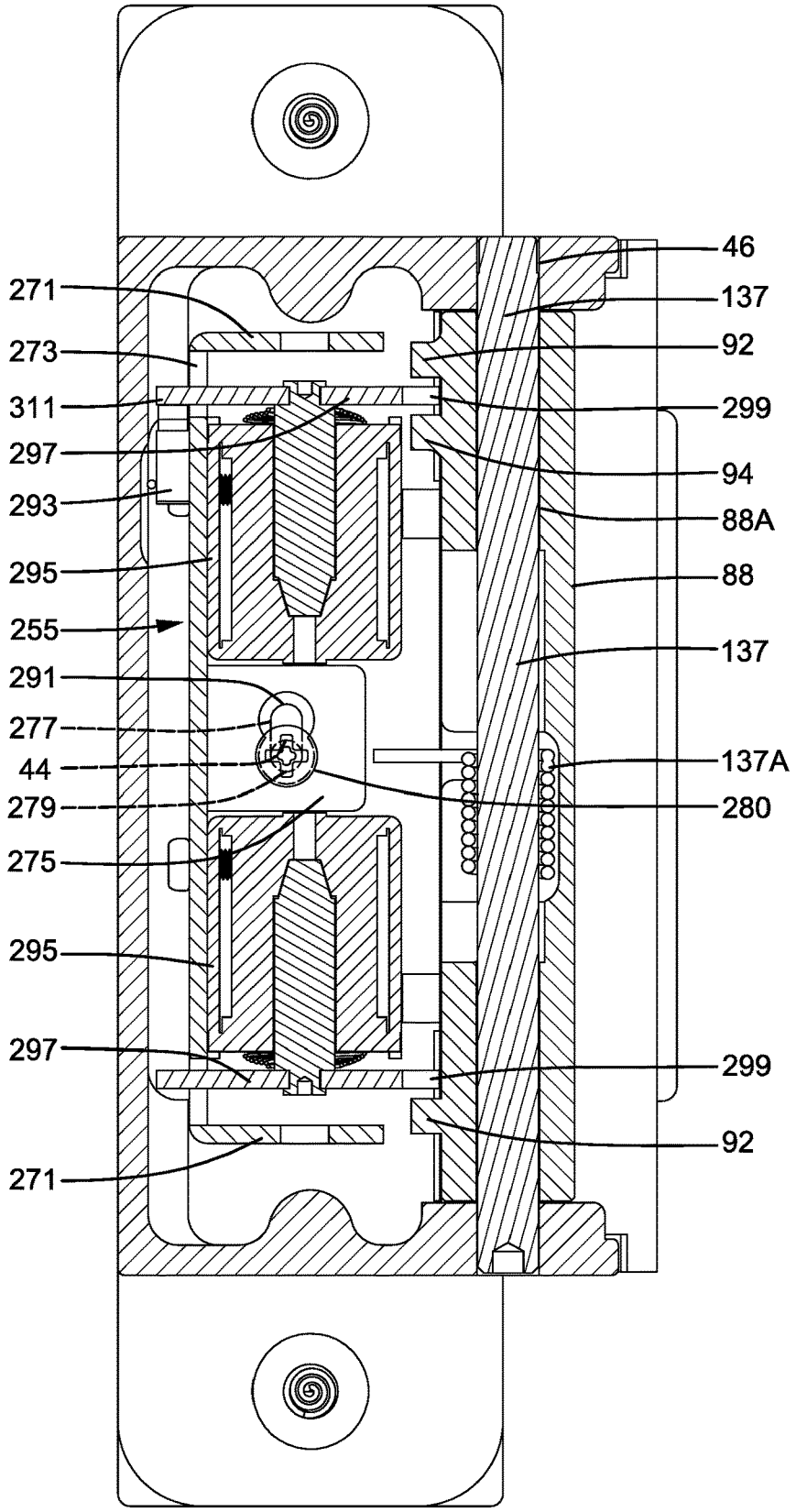
FIG. 9 is a view similar to FIG. 7 with a locking member of an electric locking device moved to a retracted position.

When the electric locking device 255 receives an unlocking signal, each of the two driving members 295 actuates a respective locking member 297 to move from the extended position (FIG. 7) to the retracted position (FIG. 9). In this state, the displacement of each of the two locking members. 297 is not impeded by the respective first coupling portion 92. Furthermore, the activation end 311 of one of the two locking members 297 presses against the status sensor 293 nearby (FIG. 9). Thus, the electric latch control device 10 is detected to be set in the unlocked state. In the unlocked state, the locking cap device 82 is not locked. Thus, when the door is pushed, the latch 151 of the cylindrical latch device 139 presses against the inner face 90 of the locking cap 84 of the locking cap device 82, pivoting the locking cap device 82 from the closure position (FIG. 5) to the non-closure position (FIG. 10). Consequently, the latch 151 of the cylindrical latch device 139 can completely disengage from the electric latch control device 10.

Figure 11:
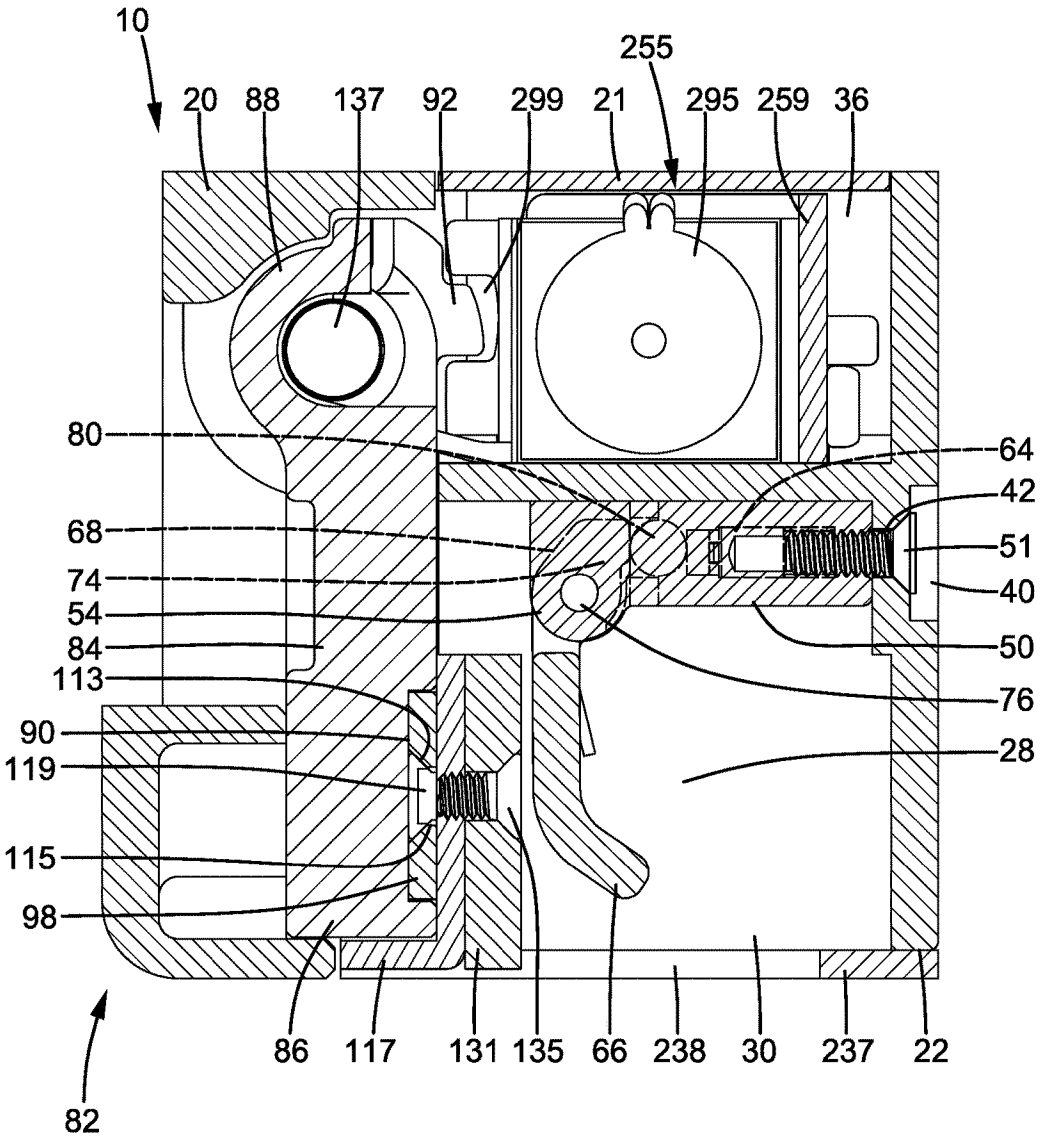
FIG. 11 is a view similar to FIG. 6 with the cylindrical latch device detached from the modularized electric latch control device.

After the latch 151 completely disengages from the electric latch control device 10, the return spring 137A returns the locking cap 84 to the closure position, and the bias spring 78 returns the actuation plate 66 to the contact position (FIG. 11). The closure detection sensor 64 is pressed by the pressing member 80, such that each of the two driving members 295 moves a respective locking member 297 from the retracted position to the extended position. The two first coupling portions 92 of the locking cap device 82 reengage with the insertion grooves 299 of the two locking members 297, thereby locking the locking cap device 82.

When it is intended to close the door after the locking cap device 82 is locked while the latch 151 of the cylindrical latch device 139 is outside of the first compartment 28 of the mounting seat 20, the latch 151 of the cylindrical latch device 139 is pressed by the locking cap device 82 and retracts (not shown), such that cylindrical latch device 139 moves together with the door to a position aligned with the first outlet 238 of the first escutcheon 237. The latch 151 moves to the extended position and actuates the actuation plate 66 to pivot from the contact position to the non-contact position again. Consequently, the latch 151 of the cylindrical latch device 139 is locked in the first compartment 28 of the mounting seat 20.

Figure 12:
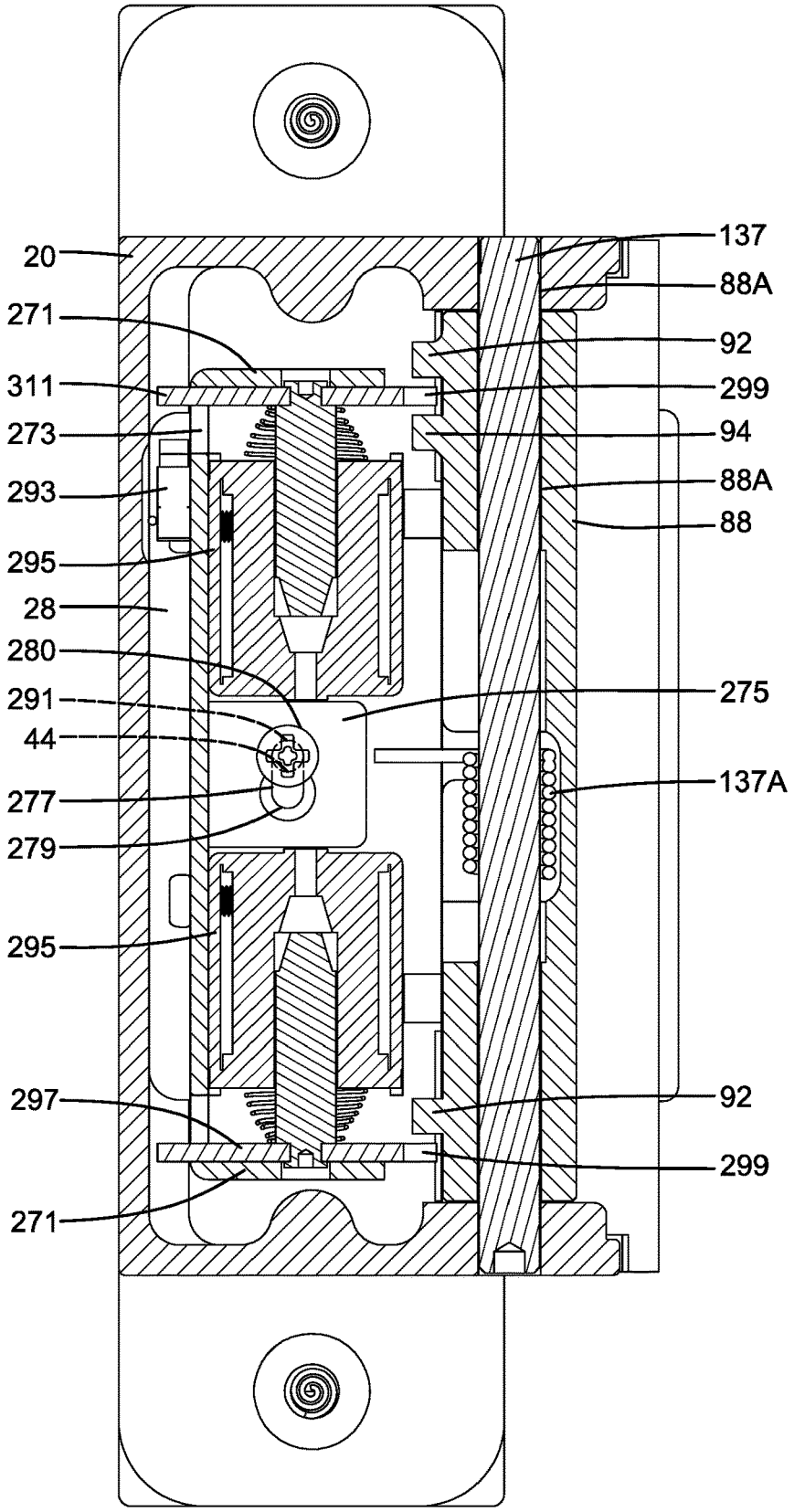
FIG. 12 is a cross sectional view of the modularized electric latch control device installed in a second position and with the locking member in an extended position.
Figure 13:
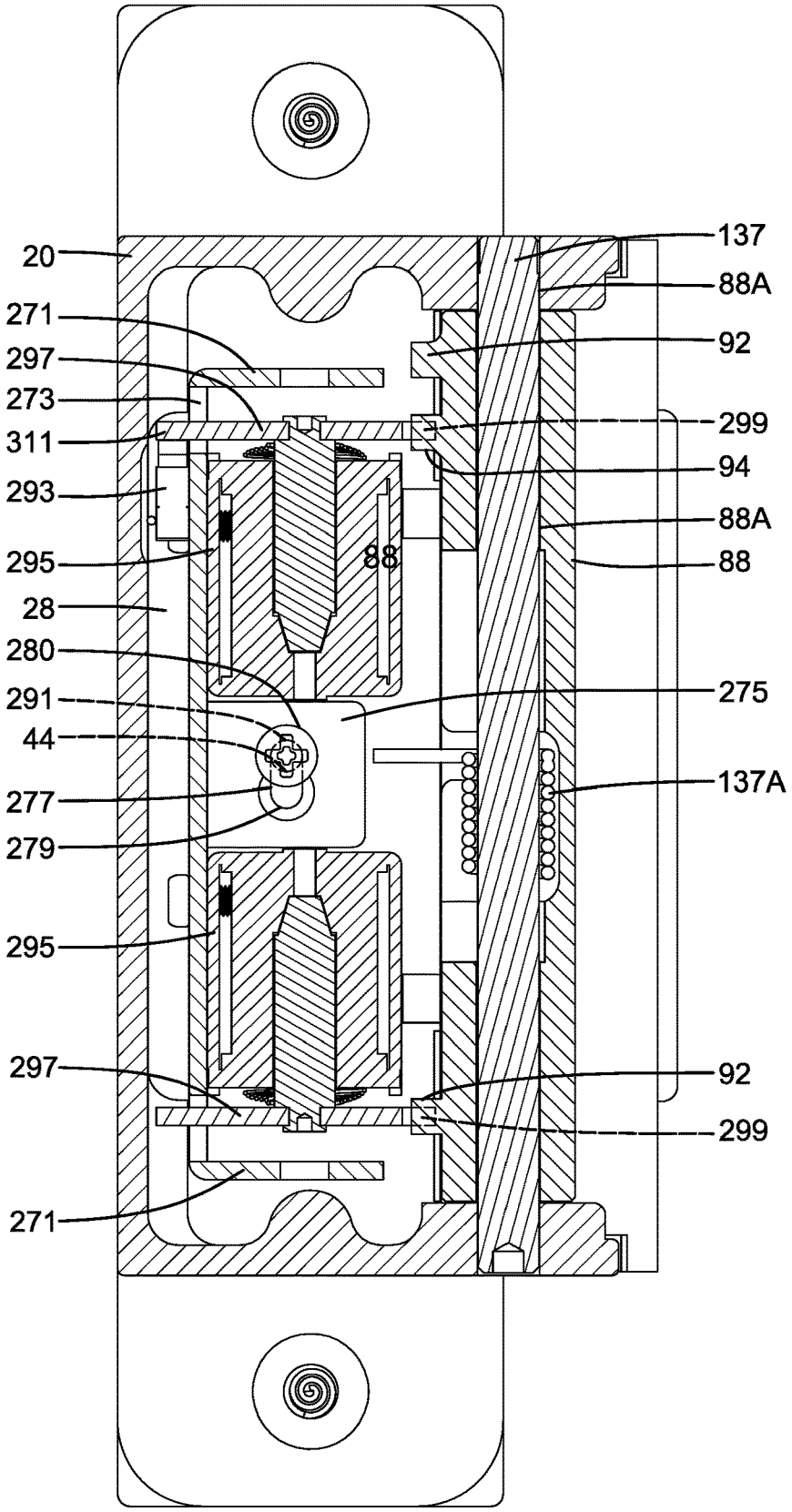
FIG. 13 is a view similar to FIG. 12 with the locking member in a retracted position.

Furthermore, in addition to setting the electric locking device 255 installed in the first position as a normally closed state, the electric locking device 255 installed in the second position can be set as a normally open state. With reference to FIG. 12, in a case that the electric locking device 255 is installed in the second position, when the locking cap device 82 is in the closure position and each of the two locking members 297 is in the extended position, one of the two locking members 297 is misaligned from the first and second coupling portions 92 and 94, and the other locking member 297 is misaligned from the two first coupling portions 92, such that the locking cap device 82 is not locked. As a result, the latch 151 of the cylindrical latch device 139 is pivotable together with the door to pivot the locking cap device 82 from the closure position to the non-closure position. With reference to FIG. 13, when each of the two driving members 295 actuates the respective locking member 297 to the retracted position and the locking cap device 82 is in the closure position, the insertion groove 299 of one of the two locking members 297 engages with the second engaging portion 94, and the other locking member 297 engages with one of the two first coupling portions 92. Thus, the locking cap device 82 is locked.

Thus, by changing the installation position of the electric locking device 255 in the first position or the second position, the electric latch control device 10 can be set in a normally open state or a normally closed state.

In addition to assembling the electric latch control device 10 into the first mode cooperating with the cylindrical latch device 139, the electric latch control device 10 can be assembled into a second mode for cooperating with a first box type latch device 153. With reference to FIGS. 15-18, the first box type latch device 153 is mounted inside a door and includes a first latch 155 and a first anti-pick latch 157. The first latch 155 and the first anti-pick latch 157 are exposed outside of an end face of the door.

Since the first latch 157 of the first box type latch device 153 is at a lower side of the first compartment 28, after loosening the two fasteners 51 from the outside of the mounting seat 20, the detecting device 48 is moved to a position near the lower end of the first compartment 28 (FIG. 17) and is then fixed. Next, the guiding plate 98 is detached from the locking cap 84, the connecting member 117 is detached and moved to a position aligned with the detecting device 48, and the guiding plate 98 is re-fixed to the inner face 90 of the locking cap 84. Furthermore, a second lining member 133 of a size conforming to the first latch 155 of the first box type latch device 153 is screwed by two screws 135 to the connecting member 117. The second escutcheon 251 is mounted to the front face 22 of the mounting seat 20 to match with the position of the first latch 155 of the first box type latch device 153.

Figure 14:
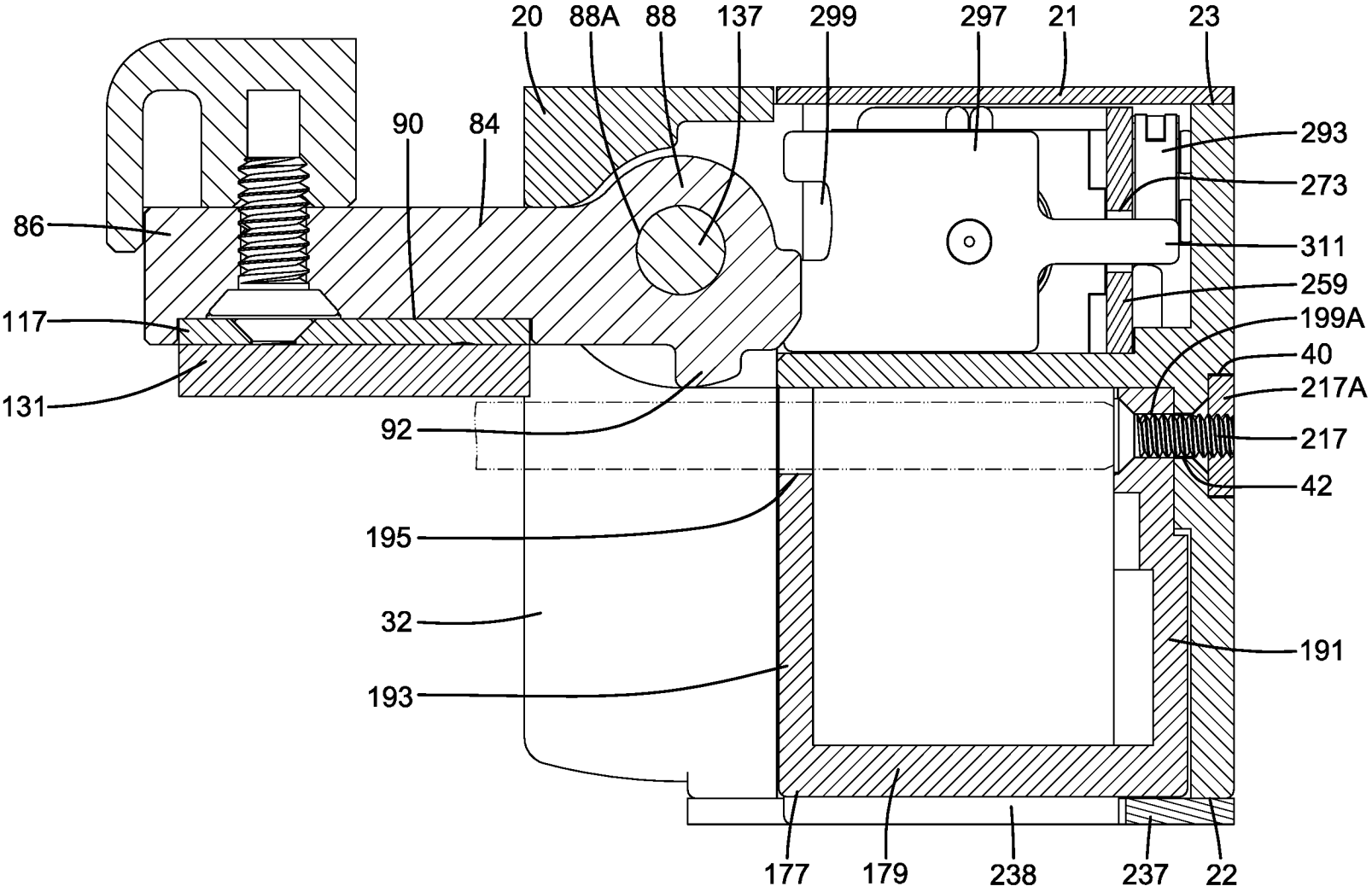
FIG. 14 is a cross sectional view illustrating mounting or detachment of a closure member while the locking cap device is in a non-closure position.
Figure 15:
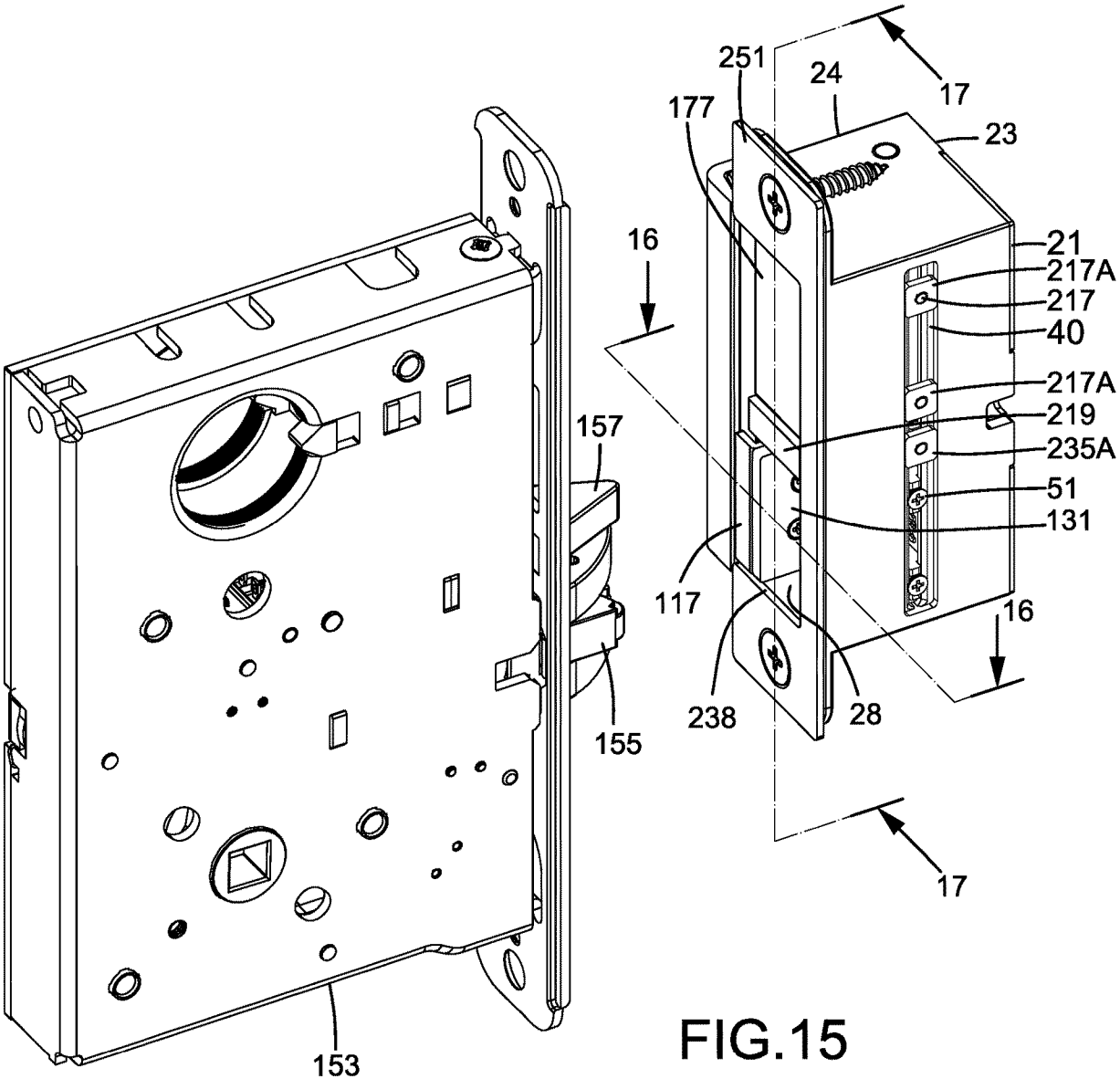
FIG. 15 is a perspective view of the modularized electric latch control device assembled into a second mode for cooperating with a first box type latch device.

Furthermore, when it is desired to assemble the electric latch control device 10 into the second mode, the closure member 177 and the stopper 219 corresponding to the first anti-pick latch 157 are installed in the first compartment 28 of the mounting seat 20. Since the first box type latch device 153 does not include a locking latch, the empty space in the first compartment 28 must be filled. In an approach, the closure member 177 is disposed in a position near the upper end of the first compartment 28 to conform to the position of the first box type latch device 153. To fix the closure member 177 in the first compartment 28, the locking cap device 82 is firstly set in the unlocked state and is pivoted to the non-closure position. With reference to FIG. 14, the sidewall 193 and the two through-holes 195 of the closure member 177 are exposed at the second opening 32. Then, a screwdriver, (or the like) can be used to extend two screws 217 through the two through-holes 195 and the two assembling holes 191A and to engage the two screws 217 with two first nuts 217 disposed in the receiving portion 40 of the track 38 and having square cross sections. Thus, the closure member 177 fixed in the first compartment 28 is near the upper end of the first compartment 28.

The stopper 219 is received in the first compartment 28 and is aligned with the first anti-pick latch 157 of the first box type latch device 153 (i.e., between the detecting device 48 and the closure member 177). The protrusion 231A of the stopper 219 is located in the through portion 42 of the track 38. With the locking cap device 82 in the non-closure position, a screwdriver can be used to extend a screw 235 through the assembling end 231 of the stopper 219 and to engage the screw 235 with a second nut 235A in the through portion 42 of the track 38. Thus, the stopper 219 can be fixed in a position aligned with the first anti-pick latch 157.

Figure 16:
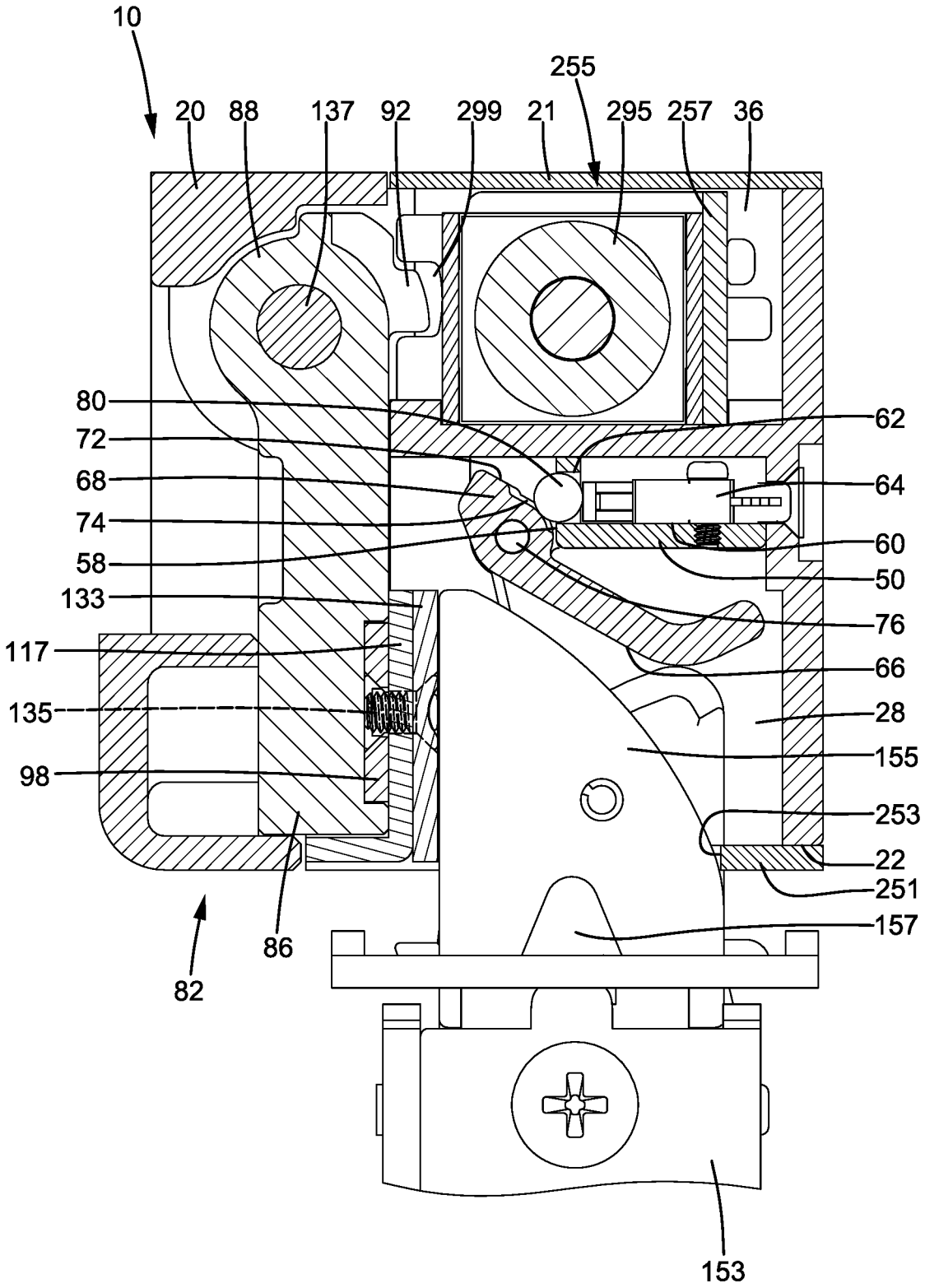
FIG. 16 is a cross sectional view taken along section line 16-16 of FIG. 15 after assembly.
Figure 17:
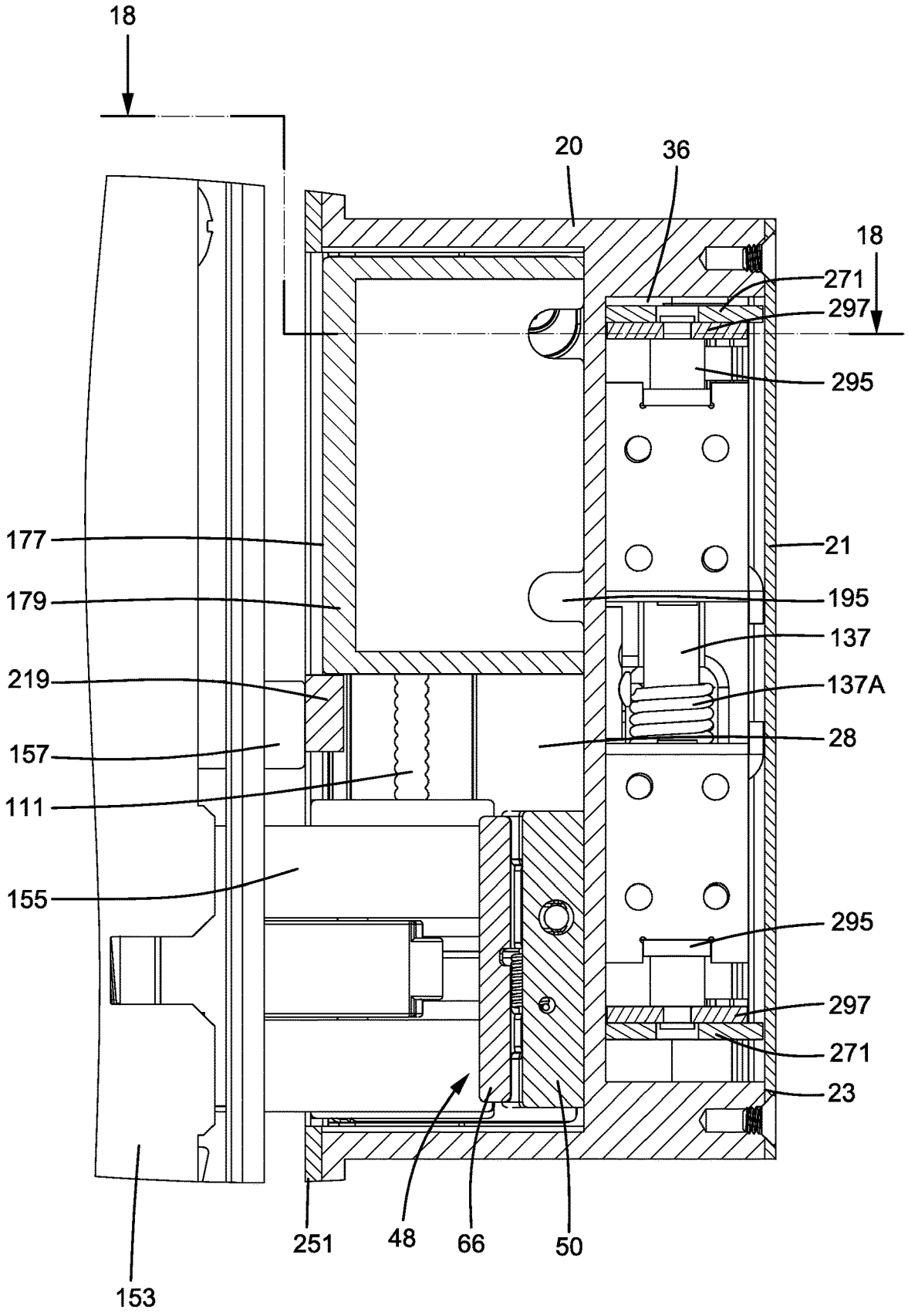
FIG. 17 is a cross sectional view taken along section line 17-17 of FIG. 15 after assembly.

With reference to FIG. 16, when the first latch 155 is in the first compartment 28, the actuation plate 66 of the detecting device 48 is pressed by the first latch 155 to the non-contact position. With reference to FIGS. 17 and 18, the first anti-pick latch 157 is pressed by the stopping end 233 of the stopper 219 and retracts. With the first anti-pick latch 157 in the retracted state, the first latch 155 cannot be pressed and retracted. Thus, the first latch 155 provides an anti-pick effect. The space in the first compartment 28 not cooperating with the first box type latch device 153 is filled by the closure member 177 (see FIG. 17).

Similarly, when the door is pushed while the locking cap device 82 is in the unlocked state, the first latch 155 of the first box type latch device 153 presses against the second lining member. 133 to pivot the locking cap device 82 from the closure position to the non-closure position. On the other hand, when the locking cap device 82 is in the locked state, the first latch 155 of the first box type latch device 153 is restrained in the first compartment 28 of the mounting seat 20.

Figure 19:
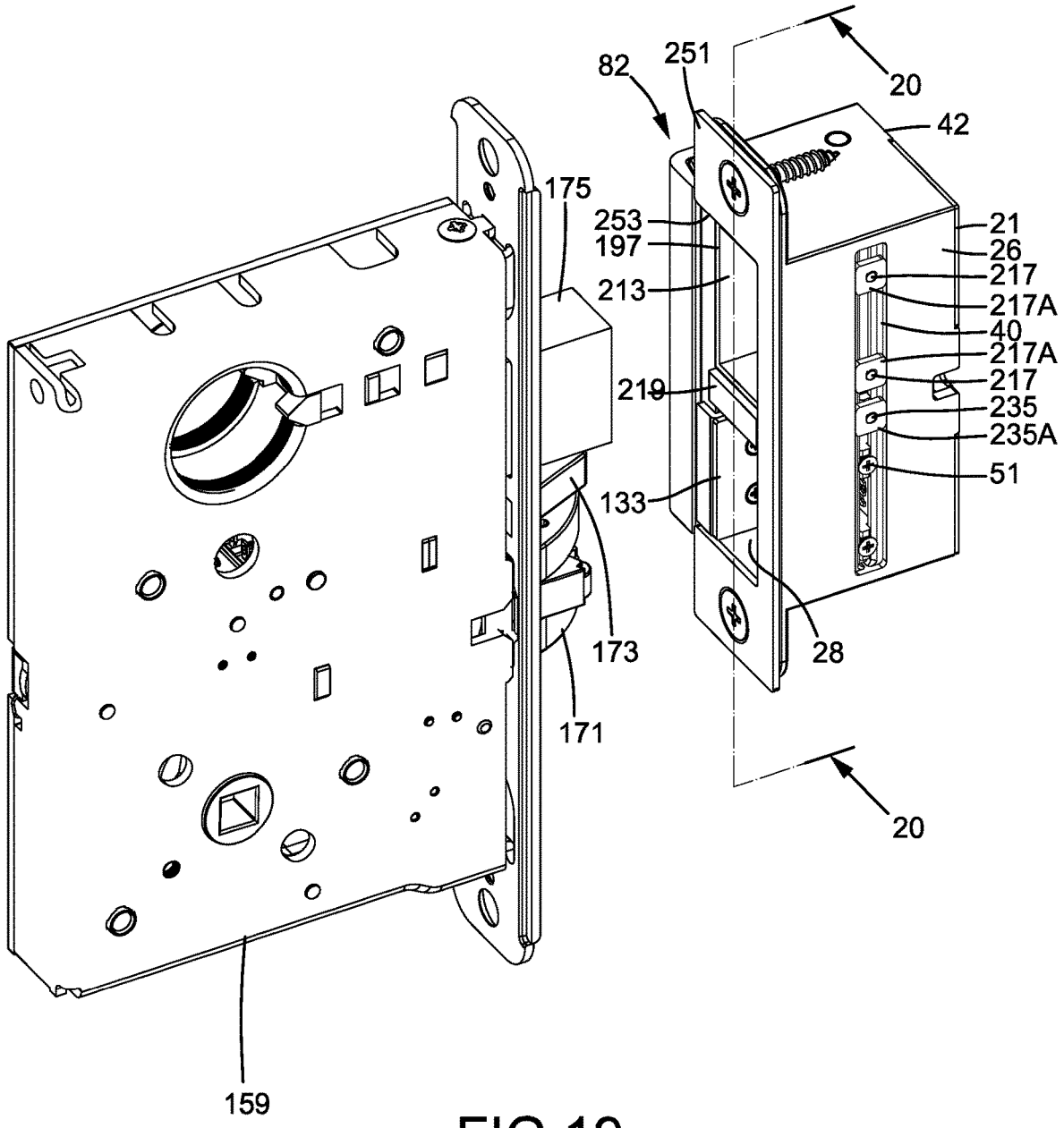
FIG. 19 is a perspective view of the modularized electric latch control device assembled into a third mode for cooperating with a second box type latch device.
Figure 20:
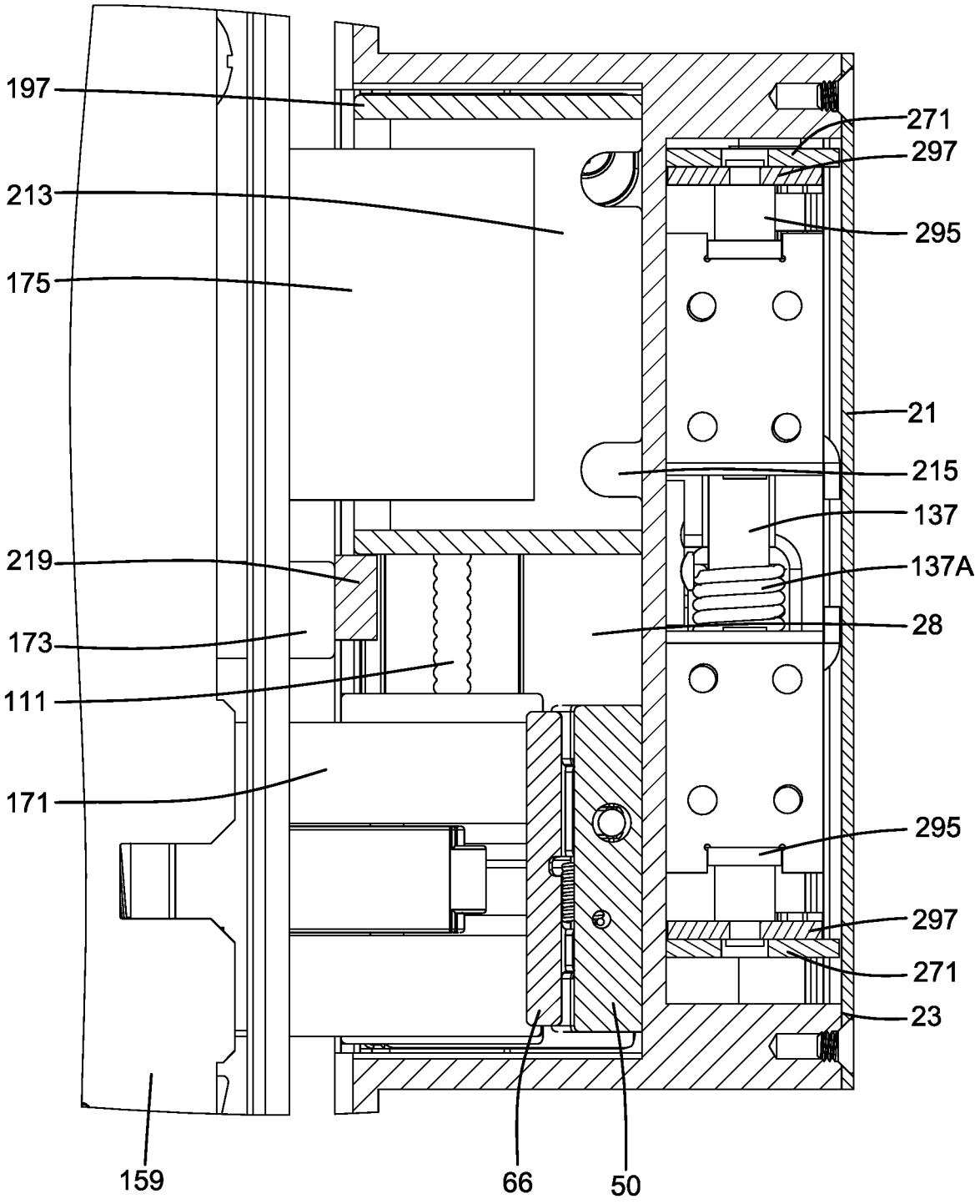
FIG. 20 is a cross sectional view taken along section line 20-20 of FIG. 19 after assembly.

With reference to FIGS. 19 and 20, the electric latch control device 10 can be assembled into a third mode for cooperating with a second box type latch device 159. The second box type latch device 159 includes a second latch 171, a second anti-pick latch 173, and a locking latch 175 movable between an extended position and a retracted position. The second anti-pick latch 173 is located between the locking latch 175 and the second latch 171.

When the electric latch control device 10 is assembled into the third mode to cooperate with the second box type latch device 159, the locking latch restraining frame 197 and the stopper 219 are installed in the first compartment 28 of the mounting seat 20. When the locking cap device 82 is in the non-closure position, the locking latch restraining frame 197 permits use of a screw driver to extend two screws 217 through the two through-holes 215 and the two mounting holes 199A and to engage the two screws 217 with two first nuts 217A received in the receiving portion 40 of the track 38. Thus, the locking latch restraining frame 197 is fixed in the first compartment 28 and near the upper end of the first compartment 28. Similarly, the stopper 219 is fixed between the locking latch restraining frame 197 and the detecting device 48. The second escutcheon 251 is installed on the front face 22 of the mounting seat 20. Thus, the locking latch restraining frame 197 is aligned with the locking latch 175, the second anti-pick latch 173 is aligned with the stopper 219, and the second latch 171 is aligned with the detecting device 48.

When the door is closed, the locking latch 175 is received in the locking latch hole 213 of the locking latch restraining frame 197, the second anti-pick latch 173 is pressed by the stopping end 233 of the stopper 219 and retracts, and the second latch 171 is received in the first compartment 28.

Since the locking latch restraining frame 197 is fixed in the first compartment 28, when the locking latch 175 is located in the locking latch hole 213 of the locking latch restraining frame 197 (see FIG. 19), the locking latch 175 cannot pivot together with the door to disengage from the locking latch restraining frame 197, such that even if the locking cap device 82 is set in the unlocking state, the second latch 171 cannot move the locking cap device 82 from the closure position to the non-closure position, thereby providing a locking function.

When the locking latch 175 of the second box type latch device 159 retracts and disengages from the locking latch hole 213 of the locking latch restraining frame 197, if the locking cap device 82 is set in the locking state, the second latch 171 still cannot pivot the locking cap device 82 to the non-closure position outside of the first compartment 28, thereby providing a locking function.

When the locking latch 175 of the second box type latch device 159 retracts and disengages from the locking latch hole 213 of the locking latch restraining frame 197, if the locking cap device 82 is set in the unlocked state, the second latch 171 can pivot the locking cap device 82 to the non-closure position outside of the first compartment 28, thereby providing an unlocking function.

The electric control device 10 can be used to electrically control opening of the door without replacing the original cylindrical latch device or the original box type latch device by assembling the electric latch control device 10 into the first, second, or third mode, which can be achieved rapidly.

After moving the locking cap device 82 to the non-closure position, the electric latch control device 10 can be rapidly assembled to conform to the associated latch device by selective assembly, detachment, or adjustment of the position of the closure member 177, the locking latch restraining frame 197, or the stopper 219.

The electric locking device 255 can be installed in the first position or the second position to rapidly set the electric latch control device 10 in a normally open state or a normally closed state.

Now that the basic teachings of the present invention have been explained, many extensions and variations will be obvious to one having ordinary skill in the art. For example, the electric latch control device 10 can cooperate with a latch device other than the cylindrical latch device 139, the first box type latch device 153, and the second box type latch device 159. When the electric latch control device 10 is assembled into the second mode, a latch device other than the first box type latch device 153 can be used by adjusting the positions of the locking latch restraining frame 197, the closure member 177, and the detecting device 48 in the first compartment 28 as well as the positions of the first latch 155 and the first anti-pick latch 157. Furthermore, when the electric latch control device 10 is assembled into the third mode, a latch device other than the second box type latch device 159 can be used by adjusting the positions of the locking latch restraining frame 197, the closure member 177, and the detecting device 48 in the first compartment 28 as well as the positions of the second latch 171 and the second anti-pick latch 159.

Furthermore, the locking cap 84 can include only one first coupling portion 92, the sidewall 193 can include only one through-hole 195, the end wall 211 can include only one through-hole 215, and the mounting wall 199 can include only one assembling hole 199A. Furthermore, the electric latch control device 10 can include only one driving member 295 and only one locking member 297.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A modularized electric latch control device comprising:

a mounting seat including a first compartment having a first opening and a second opening;

a closure member;

a locking latch restraining frame;

a stopper;

a first escutcheon including a first outlet smaller than the first opening;

a second escutcheon including a second outlet substantially identical to the first opening; and a locking cap device pivotably connected to the mounting seat and fixably mounted to the mounting seat, wherein when the locking cap device is not fixed, the locking cap device is pivotable relative to the mounting seat between a closure position closing the second opening and a non-closure position not closing the second opening, and wherein when the locking cap device is fixed, the locking cap device is not pivotable from the closure position to the non-closure position;

wherein the electric latch control device is selectively assembled into a first mode, a second mode, or a third mode, wherein when the electric latch control device is selectively assembled into the first mode, the first escutcheon is selected and coupled with the mounting seat and covers a portion of the first opening, and the first outlet is aligned with the first opening, wherein when the electric latch control device is selectively assembled into the second mode, the second escutcheon is selected and coupled with the mounting seat, the second outlet is aligned with the first opening, the closure member and the stopper are selected and mounted in the first compartment, each of the closure member and the stopper blocks a portion of the first compartment, and the closure member and the stopper are aligned with the second outlet of the second escutcheon;

wherein when the electric latch control device is selectively assembled into the third mode, the second escutcheon is selected and coupled with the mounting seat, the second outlet is aligned with the first opening, the locking latch restraining frame and the stopper are selected and mounted in the first compartment, each of the locking latch restraining frame and the stopper blocks a portion of the first compartment, wherein the locking latch restraining frame defines a locking latch hole, and the locking latch restraining frame and the stopper are aligned with the second outlet, wherein when the locking cap device is in the closure position, the closure member, the locking latch restraining frame, and the stopper are prevented from being detached from or mounted into the first compartment, wherein when the locking cap device is in the non-closure position, the closure member, the locking latch restraining frame, and the stopper are permitted to be detached from or mounted into the first compartment, wherein the mounting seat further includes a track, wherein the closure member includes an outer wall, a sidewall, and an assembling wall, wherein the outer wall extends between the sidewall and the assembling wall, wherein the sidewall includes a through-hole, wherein the assembling wall includes an assembling hole aligned with the through-hole, wherein when the closure member is selected and mounted, the sidewall of the closure member faces the locking cap device, and the assembling hole is aligned with the track, wherein when the locking cap device is in the non-closure position, the sidewall of the closure member is exposed to permit a screw to extend through the through-hole of the closure member, the assembling hole, and the track, wherein a first nut is coupled with the screw to fix the closure member in the first compartment when the closure member is selected and mounted, wherein the screw is detachable from the first nut to permit detachment of the closure member from the first compartment.

2. The modularized electric latch control device as claimed in claim 1, wherein the locking latch restraining frame includes an end wall and a mounting wall, wherein the end wall includes another through-hole, wherein the mounting wall includes a mounting hole aligned with the another through-hole, wherein when the locking latch restraining frame is selected and mounted, the end wall of the locking latch restraining frame faces the locking cap device, and the mounting hole is aligned with the track, wherein when the locking cap device is in the non-closure position, the end wall of the locking latch restraining frame is exposed to permit the screw to extend through the another through-hole of the locking latch restraining frame, the mounting hole, and the track, wherein the first nut is coupled with the screw to fix the locking latch restraining frame in the first compartment when the locking latch restraining frame is selected and mounted, wherein the screw is detachable from the first nut to permit detachment of the locking latch restraining frame from the first compartment.

3. The modularized electric latch control device as claimed in claim 2, wherein the track includes a receiving portion contiguous to a side of the mounting seat and spaced from the first compartment, wherein the track further includes a through portion extending between the receiving portion and the first compartment, wherein the through portion is smaller than the receiving portion, and wherein the first nut is received in the receiving portion of the track.

4. The modularized electric latch control device as claimed in claim 3, wherein the stopper further includes an assembling end, wherein the assembling end includes a protrusion configured to be received in the through portion of the track, wherein when the locking cap device is in the non-closure position, the assembling end of the stopper is exposed to permit another screw to extend through the assembling end of the stopper and the track, wherein a second nut is coupled with the another screw to fix the stopper in the first compartment, wherein the another screw is detachable from the second nut to permit detachment of the stopper from the first compartment.

5. The modularized electric latch control device as claimed in claim 1, further comprising:

a detecting device adjustably mounted in the first compartment, wherein the mounting seat further includes a front face and a rear face spaced from the front face, wherein the mounting seat further includes first and second sides extending between the front face and the rear face, wherein the first opening is located in the front face, wherein the second opening is located in the first side, wherein the track is formed on the second side and intercommunicates with the first compartment, wherein the track is located between the front face and the rear face, wherein the detecting device is movable along the track to adjust a desired location relative to the first compartment; and an electric locking device, wherein the mounting seat further includes a second compartment in the rear face, wherein the electric locking device is mounted in the second compartment and is fixably connected to the locking cap device, and wherein the electric locking device is configured to lock the locking cap device in the closure position.

6. The modularized electric latch control device as claimed in claim 5, wherein the detecting device further includes:

a supporting seat including a pivotal end, wherein a pivotal groove is defined in the pivotal end and includes a through-hole;

an actuation plate includes a lug pivotably connected to the pivotal end, wherein the lug includes an abutting face, wherein the actuation plate is pivotable relative to the supporting seat between a contact position and a non-contact position;

a pressing member movably received in the through-hole of the supporting seat and abutting the abutting face of the actuation plate; and a closure detection member coupled to the supporting seat and contiguous to a side of the pressing member, wherein when the actuation plate is in the contact position, the pressing member presses against the closure detection member, and wherein when the actuation plate is in the non-contact position, the pressing member does not press against the closure detection member.

7. The modularized electric latch control device as claimed in claim 6, wherein the actuation plate further includes a channel in the abutting face, wherein the pressing member is outside of the channel when the actuation plate is in the contact position, and wherein the pressing member is in the channel when the actuation plate is in the non-contact position.

8. The modularized electric latch control device as claimed in claim 5, wherein the locking cap device further includes a locking cap having an inner side pivotably connected to the mounting seat, wherein the locking cap further including a first coupling portion formed on the inner side and extending into the second compartment, wherein the locking cap further includes a second coupling portion spaced from the first coupling portion and located in the second compartment, wherein the electric locking device further includes:

a bracket including an engaging wall having an engaging slot, wherein the engaging slot has a first end and a second end, wherein the seat includes an engaging portion between the first compartment and the second compartment, wherein the bracket is selectively engaged with the engaging portion in a first position or a second position, wherein in the first position, the first end of the engaging slot of the bracket is coupled with the engaging portion, and wherein in the second position, the second end of the engaging slot of the bracket is coupled with the engaging portion;

a driving member fixed on the bracket; and a locking member coupled to and jointly movable with the driving member, wherein the locking member includes an insertion groove corresponding to the first coupling portion, wherein the driving member moves the locking member to an extended position or a retracted position, wherein when the bracket is in the first position and the locking member is in the extended position, the insertion groove of the locking member is coupled with the first coupling portion, the locking cap device is locked and is prevented from pivoting from the closure position to the non-closure position, wherein when the bracket is in the first position and the locking member is in the retracted position, the locking member is located between the first coupling portion and the second coupling portion, the locking cap device is unlocked and is pivotable from the closure position to the non-closure position, wherein when the bracket is in the second position and the locking member is in the extended position, the locking member is located between the first coupling portion and the second coupling portion, the locking cap device is unlocked and is pivotable from the closure position to the non-closure position, and wherein when the bracket is in the second position and the locking member is in the retracted position, the insertion groove of the locking member is coupled with the second coupling portion, the locking cap device is locked and is prevented from pivoting from the closure position to the non-closure position.

9. The modularized electric latch control device as claimed in claim 1, wherein the locking cap device further includes:

a locking cap pivotably connected to the mounting seat, wherein the locking cap includes an inner face, wherein the inner face faces the first compartment when the locking cap is in the closure position;

a guiding plate detachably mounted to the inner face of the locking cap, wherein the guiding plate includes a first face and a second face, wherein the guiding plate further includes a guiding groove extending from the first face through the second face, and wherein the second face of the guiding plate faces the inner face of the locking cap;

a connecting member;

a second screw extending from the second face through the guiding slot of the guiding plate and threadedly engaged with the connecting member to detachably mount the connecting member to the first face of the guiding plate;

a third screw;

a first lining member;

a second lining member, wherein the first lining member has a thickness larger than a thickness of the second lining member; and wherein the connecting member is selectively and detachably coupled with a selected one of the first lining member and the second lining member by extending the third screw through the selected one of the first lining member and the second lining member.

10. The modularized electric latch control device as claimed in claim 9, wherein the guiding groove of the guiding plate includes an enlarged portion extending from the second face towards but spaced from the first face and a positioning portion extending between the enlarged portion and the first face, wherein the positioning portion includes a surface having a plurality of protrusions and a plurality of recesses, with the protrusions and the recesses alternately disposed, wherein the connecting member further includes an engaging block having a shape corresponding to the positioning portion, wherein the engaging block of the connecting member is coupled to a selected position on the positioning portion of the guiding groove, and wherein the second screw has a head received in the enlarged portion of the guiding plate.

11. A modularized electric latch control device comprising:

a mounting seat including a first compartment having a first opening and a second opening;

a closure member;

a locking latch restraining frame;

a stopper;

a first escutcheon including a first outlet smaller than the first opening;

a second escutcheon including a second outlet substantially identical to the first opening;

a locking cap device pivotably connected to the mounting seat and fixably mounted to the mounting seat, wherein when the locking cap device is not fixed, the locking cap device is pivotable relative to the mounting seat between a closure position closing the second opening and a non-closure position not closing the second opening, and wherein when the locking cap device is fixed, the locking cap device is not pivotable from the closure position to the non-closure position;

a cylindrical latch device having a latch;

a first box type latch device including a first latch and a first anti-pick latch operatively connected to the first latch, wherein the first latch is retractable when the first anti-pick latch is in an extended position, and wherein the first latch is not retractable when the first anti-pick latch is in a retracted position;

a second box type latch device including a second latch and a second anti-pick latch operatively connected to the second latch, wherein the second latch is retractable when the second anti-pick latch is in an extended position, wherein the second latch is not retractable when the second anti-pick latch is in a retracted position;

the electric latch control device is selectively assembled into a first mode, a second mode, or a third mode to couple with the cylindrical latch device, the first box type latch device, or the second box type latch device, wherein when the electric latch control device is selectively assembled into the first mode, the first escutcheon is selected and coupled with the mounting seat and covers a portion of the first opening, and the first outlet is aligned with the first opening, wherein the first compartment receives the latch of the cylindrical latch device, wherein the latch of the cylindrical latch device is prevented from disengaging from the first compartment when the locking cap device is locked, wherein when the locking cap device is unlocked, the locking cap device is actuatable by the latch of the cylindrical latch device to pivot from the closure position to the non-closure position to thereby disengage from the first compartment, wherein when the electric latch control device is selectively assembled into the second mode, the second escutcheon is selected and coupled with the mounting seat, the second outlet is aligned with the first opening, the closure member and the stopper are selected and mounted in the first compartment, each of the closure member and the stopper blocks a portion of the first compartment, wherein the closure member and the stopper are aligned with the second outlet of the second escutcheon, wherein the first compartment receives the first latch of the first box type latch device, wherein the stopper is configured to press and retract the first anti-pick latch, wherein the first latch of the first box type latch device is prevented from disengaging from the first compartment when the locking cap device is locked, and wherein when the locking cap device is unlocked, the locking cap device is actuatable by the first latch of the first box type latch device to pivot from the closure position to the non-closure position to thereby disengage from the first compartment, wherein when the electric latch control device is selectively assembled into the third mode, the second escutcheon is selected and coupled with the mounting seat, the second outlet is aliened with the first opening, the locking latch restraining frame and the stopper are selected and mounted in the first compartment, each of the locking latch restraining frame and the stopper blocks a portion of the first compartment, wherein the locking latch restraining frame defines a locking latch hole, wherein the locking latch restraining frame and the stopper are aliened with the second outlet of the second escutcheon, wherein the first compartment receives the second latch of the second box type latch device, wherein the stopper is configured to press and retract the second anti-pick latch, wherein the locking latch hole of the locking latch restraining frame is configured to receive the locking latch of the second box type latch device, wherein the second latch of the second box type latch device is prevented from disengaging from the first compartment when locked, wherein the second latch of the second box type latch device is prevented from disengaging from the first compartment when the locking cap device is unlocked and the locking latch of the second box type latch device is received in the locking latch hole of the locking latch restraining frame, and wherein when the locking cap device is unlocked and the locking latch of the second box type latch device is outside of the locking latch hole of the locking latch restraining frame, the locking cap device is actuatable by the second latch of the second box type latch device to pivot from the closure position to the non-closure position to thereby disengage from the first compartment, wherein when the locking cap device is in the closure position, the closure member, the locking latch restraining frame, and the stopper are prevented from being detached from or mounted into the first compartment, wherein when the locking cap device is in the non-closure position, the closure member, the locking latch restraining frame, and the stopper are permitted to be detached from or mounted into the first compartment, wherein the mounting seat further includes a track, wherein the locking latch restraining frame includes an end wall and a mounting wall, wherein the end wall includes a through-hole, wherein the mounting wall includes a mounting hole aligned with the through-hole, wherein when the locking latch restraining frame is selected and mounted, the end wall of the locking latch restraining frame faces the locking cap device, and the mounting hole is aligned with the track, wherein when the locking cap device is in the non-closure position, the end wall of the locking latch restraining frame is exposed to permit a screw to extend through the through-hole of the locking latch restraining frame, the mounting hole, and the track, wherein a first nut is coupled with the screw to fix the locking latch restraining frame in the first compartment, wherein the screw is detachable from the first nut to permit detachment of the locking latch restraining frame from the first compartment.

12. The modularized electric latch control device as claimed in claim 11, wherein the track includes a receiving portion contiguous to a side of the mounting seat and spaced from the first compartment, wherein the track further includes a through portion extending between the receiving portion and the first compartment, wherein the through portion is smaller than the receiving portion, and wherein the first nut is received in the receiving portion of the track.

13. The modularized electric latch control device as claimed in claim 11, wherein the detecting device includes:

a supporting seat including a pivotal end, wherein a pivotal groove is defined in the pivotal end and includes a through-hole;

an actuation plate includes a lug pivotably connected to the pivotal end, wherein the lug includes an abutting face, wherein the actuation plate is pivotable relative to the supporting seat between a contact position and a non-contact position;

a pressing member movably received in the through-hole of the supporting seat and abutting the abutting face of the actuation plate; and a closure detection member coupled to the supporting seat and contiguous to a side of the pressing member;

wherein when one of the latch of the cylindrical latch device, the first latch of the first box type latch device, and the second latch of the second box type latch device is located in the first compartment and when the actuation plate is in the contact position, the pressing member presses against the closure detection member, and wherein when one of the latch of the cylindrical latch device, the first latch of the first box type latch device, and the second latch of the second box type latch device is located in the first compartment and when the actuation plate is in the non-contact position, the pressing member does not contact the closure detection member.

14. A modularized electric latch control device comprising:

a mounting seat including a first compartment having a first opening and a second opening, wherein the mounting seat further includes a track;

an escutcheon including an outlet substantially identical to the first opening, wherein the escutcheon is coupled to the mounting seat, and wherein the outlet is aligned with the first opening;

a locking cap device pivotably connected to the mounting seat and fixably mounted to the mounting seat, wherein when the locking cap device is not fixed, the locking cap device is pivotable relative to the mounting seat between a closure position closing the second opening and a non-closure position not closing the second opening, and wherein when the locking cap device is fixed, the locking cap device is not pivotable from the closure position to the non-closure position;

a closure member including an outer wall, a sidewall, and an assembling wall, wherein the outer wall extends between the sidewall and the assembling wall, wherein the sidewall includes a through-hole, wherein the assembling wall includes an assembling hole, wherein the closure member is selectively and detachably received in the first compartment;

a first nut detachably received in the track of the mounting seat and aligned with the assembling hole of the closure member;

a stopper selectively and detachably received in the first compartment;

wherein when the closure member and the stopper are initially not mounted in the first compartment and the locking cap device is in the closure position, installation of the closure member and the stopper into the first compartment is prevented, and when the closure member and the stopper are initially mounted in the first compartment and the locking cap device is in the closure position, detachment of the closure member and the stopper from the first compartment is prevented, wherein when the closure member and the stopper are mounted in the first compartment, the assembling hole of the closure member is aligned with the through-hole and the track, the closure member blocks a portion of the first compartment and is aligned with the outlet of the escutcheon, and the stopper blocks another portion of the first compartment and is aligned with the outlet of the escutcheon, wherein when the locking cap device is in the non-closure position, a screw is permitted to extend through the through-hole and the assembling hole of the closure member, the track, and the first nut or the screw is permitted to be detached from the first nut, wherein when the screw is coupled with the first nut, the closure member is fixed in the first compartment, and wherein when the screw is detached from the first nut, the closure member is detachable from the first compartment.

15. The modularized electric latch control device as claimed in claim 14, wherein the stopper further includes an assembling end, wherein the assembling end includes a protrusion configured to be received in the track, wherein when the locking cap device is in the non-closure position, the assembling end of the stopper is exposed to permit another screw to extend through the assembling end of the stopper and the track, wherein a second nut is selectively coupled with the another screw to fix the stopper in the first compartment, wherein the another screw is detachable from the second nut to permit detachment of the stopper from the first compartment.

16. The modularized electric latch control device as claimed in claim 14, further comprising:

a detecting device adjustably mounted in the first compartment, wherein the mounting seat further includes a front face and a rear face spaced from the front face, wherein the mounting seat further includes first and second sides extending between the front face and the rear face, wherein the first opening is located in the front face, wherein the second opening is located in the first side, wherein the track is formed on the second side and intercommunicating with the first compartment, wherein the track is located between the front face and the rear face, wherein the detecting device is movable along the track to adjust a desired location relative to the first compartment; and an electric locking device, wherein the mounting seat further includes a second compartment in the rear face, wherein the electric locking device is mounted in the second compartment and is fixably connected to the locking cap device, and wherein the electric locking device is configured to lock the locking cap device in the closure position.

17. The modularized electric latch control device as claimed in claim 16, wherein the detecting device further includes:

a supporting seat including a pivotal end, wherein a pivotal groove is defined in the pivotal end and includes a through-hole;

an actuation plate includes a lug pivotably connected to the pivotal end, wherein the lug includes an abutting face having a channel, wherein the actuation plate is pivotable relative to the supporting seat between a contact position and a non-contact position;

a pressing member movably received in the through-hole and abutting the abutting face of the actuation plate; and a closure detection member coupled to the supporting seat and contiguous to a side of the pressing member, wherein when the actuation plate is in the contact position, the pressing member is outside of the channel and presses against the closure detection member, and wherein when the actuation plate is in the non-contact position, the pressing member is in the channel and does not press against the closure detection member.

18. A modularized electric latch control device comprising:

a mounting seat including a first compartment having a first opening and a second opening, wherein the mounting seat further includes a track;

an escutcheon including an outlet substantially identical to the first opening, wherein the escutcheon is coupled to the mounting seat, and wherein the outlet is aligned with the first opening;

a locking cap device pivotably connected to the mounting seat and fixably mounted to the mounting seat, wherein when the locking cap device is not fixed, the locking cap device is pivotable relative to the mounting seat between a closure position closing the second opening and a non-closure position not closing the second opening, and wherein when the locking cap device is fixed, the locking cap device is not pivotable from the closure position to the non-closure position;

a locking latch restraining frame including an end wall and a mounting wall, wherein the end wall includes a through-hole, wherein the mounting wall includes a mounting hole aligned with the through-hole, and wherein the locking latch restraining frame is selectively and detachably received in the first compartment;

a first nut detachably received in the track of the mounting seat and aligned with the assembling hole of the closure member;

a stopper selectively and detachably received in the first compartment;

wherein when the locking latch restraining frame and the stopper are initially not mounted in the first compartment and the locking cap device is in the closure position, installation of the locking latch restraining frame and the stopper into the first compartment is prevented, and when the locking latch restraining frame and the stopper are initially mounted in the first compartment and the locking cap device is in the closure position, detachment of the locking latch restraining frame and the stopper from the first compartment is prevented, wherein when the locking latch restraining frame and the stopper are mounted in the first compartment, the assembling hole of the closure member is aligned with the track, the locking latch restraining frame blocks a portion of the first compartment and is aligned with the outlet of the escutcheon, and the stopper blocks another portion of the first compartment and is aligned with the outlet of the escutcheon, wherein when the locking cap device is in the non-closure position, a screw is permitted to extend through the through-hole and the mounting hole of the locking latch restraining frame, the track, and the first nut or the screw is permitted to be detached from the first nut, wherein when the screw is coupled with the first nut, the locking latch restraining frame is fixed in the first compartment, and wherein when the screw is detached from the first nut, the locking latch restraining frame is detachable from the first compartment.

19. The modularized electric latch control device as claimed in claim 18, wherein the stopper further includes an assembling end, wherein the assembling end includes a protrusion configured to be received in the track, wherein when the locking cap device is in the non-closure position, the assembling end of the stopper is exposed to permit another screw to extend through the assembling end of the stopper and the track, wherein a second nut is selectively coupled with the another screw to fix the stopper in the first compartment, wherein the another screw is detachable from the second nut to permit detachment of the stopper from the first compartment.

20. The modularized electric latch control device as claimed in claim 18, further comprising:

a detecting device adjustably mounted in the first compartment, wherein the mounting seat further includes a front face and a rear face spaced from the front face, wherein the mounting seat further includes first and second sides extending between the front face and the rear face, wherein the first opening is located in the front face, wherein the second opening is located in the first side, wherein the track is formed on the second side and intercommunicating with the first compartment, wherein the track is located between the front face and the rear face, wherein the detecting device is movable along the track to adjust a desired location relative to the first compartment; and an electric locking device, wherein the mounting seat further includes a second compartment in the rear face, wherein the electric locking device is mounted in the second compartment and is fixably connected to the locking cap device, and wherein the electric locking device is configured to lock the locking cap device in the closure position.

21. The modularized electric latch control device as claimed in claim 20, wherein the detecting device further includes:

a supporting seat including a pivotal end, wherein a pivotal groove is defined in the pivotal end and includes a through-hole;

an actuation plate includes a lug pivotably connected to the pivotal end, wherein the lug includes an abutting face having a channel, wherein the actuation plate is pivotable relative to the supporting seat between a contact position and a non-contact position;

a pressing member movably received in the through-hole and abutting the abutting face of the actuation plate; and a closure detection member coupled to the supporting seat and contiguous to a side of the pressing member, wherein when the actuation plate is in the contact position, the pressing member is outside of the channel and presses against the closure detection member, and wherein when the actuation plate is in the non-contact position, the pressing member is in the channel and does not press against the closure detection member.

* * * * *